US011692742B1

(12) United States Patent
Vaisman et al.

(10) Patent No.: US 11,692,742 B1
(45) Date of Patent: Jul. 4, 2023

(54) THERMAL MANAGEMENT SYSTEMS

(71) Applicant: Booz Allen Hamilton Inc., McLean, VA (US)

(72) Inventors: Igor Vaisman, Carmel, IN (US); Joshua Peters, Knoxville, TN (US)

(73) Assignee: Booz Allen Hamilton Inc., McLean, VA (US)

( * ) Notice: Subject to any disclaimer, the term of this patent is extended or adjusted under 35 U.S.C. 154(b) by 198 days.

(21) Appl. No.: 17/189,410

(22) Filed: Mar. 2, 2021

Related U.S. Application Data

(60) Provisional application No. 63/047,371, filed on Jul. 2, 2020.

(51) Int. Cl.

| | |
|---|---|
| ***F25B 5/02*** | (2006.01) |
| ***F25B 9/08*** | (2006.01) |
| ***F25B 9/10*** | (2006.01) |
| ***F25B 40/02*** | (2006.01) |
| ***F25B 41/20*** | (2021.01) |

(Continued)

(52) U.S. Cl.
CPC ..... *F25B 5/02* (2013.01); *F25B 9/002* (2013.01); *F25B 9/08* (2013.01); *F25B 9/10* (2013.01); *F25B 40/02* (2013.01); *F25B 41/20* (2021.01); *F25B 41/32* (2021.01); *F25B 41/345* (2021.01); *F25B 49/027* (2013.01); *F25B 2345/006* (2013.01); *F25B 2400/053* (2013.01); *F25B 2400/061* (2013.01); *F25B 2500/18* (2013.01); *F25B 2500/28* (2013.01); *F25B 2600/2507* (2013.01)

(58) Field of Classification Search
CPC .... F25B 5/02; F25B 9/002; F25B 9/08; F25B 9/10; F25B 40/02; F25B 41/20; F25B 41/32; F25B 41/345; F25B 49/027; F25B 2345/006; F25B 2400/053; F25B 2400/061; F25B 2500/18; F25B 2500/28; F25B 2500/2507
See application file for complete search history.

(56) References Cited

U.S. PATENT DOCUMENTS

| | | | | |
|---|---|---|---|---|
| 10,746,440 | B2 | 8/2020 | Donovan et al. | |
| 2005/0268644 | A1* | 12/2005 | Oshitani | B60H 1/323 62/500 |

(Continued)

FOREIGN PATENT DOCUMENTS

| | | |
|---|---|---|
| JP | 2010133606 | 6/2010 |

OTHER PUBLICATIONS

Nagano, "Ejector Type Refrigeration Cycle," English Translation of Foreign Reference JP 2010133606 A, Jun. 17, 2010, Whole Document.

(Continued)

*Primary Examiner* — Kun Kai Ma
(74) *Attorney, Agent, or Firm* — Fish & Richardson P.C.

(57) ABSTRACT

A thermal management system is described. The thermal management system includes a receiver configured to store a refrigerant, the receiver having a receiver inlet and a receiver outlet, a closed-circuit refrigeration system including a vapor compression closed-circuit system that includes the receiver, and a closed-circuit system that includes the receiver, wherein the closed-circuit refrigeration system is configurable to receive refrigerant from the receiver through one or both of the vapor compression closed-circuit system and the closed-circuit system.

51 Claims, 17 Drawing Sheets

(51) Int. Cl.

| | |
|---|---|
| ***F25B 41/32*** | (2021.01) |
| ***F25B 41/345*** | (2021.01) |
| ***F25B 49/02*** | (2006.01) |
| ***F25B 9/00*** | (2006.01) |

(56) References Cited

U.S. PATENT DOCUMENTS

| | | | | |
|---|---|---|---|---|
| 2006/0254308 | A1* | 11/2006 | Yokoyama | F25D 21/08 62/500 |
| 2007/0028646 | A1* | 2/2007 | Oshitani | F25B 41/00 62/170 |
| 2011/0005268 | A1 | 1/2011 | Oshitani et al. | |
| 2013/0025305 | A1* | 1/2013 | Higashiiue | F25B 41/00 62/115 |
| 2013/0251505 | A1 | 9/2013 | Wang et al. | |
| 2015/0168024 | A1* | 6/2015 | Lee | F25D 21/006 62/511 |
| 2017/0253106 | A1 | 9/2017 | Nishijima et al. | |
| 2019/0072035 | A1 | 3/2019 | Peace et al. | |
| 2020/0363101 | A1* | 11/2020 | Jansen | F25B 40/02 |
| 2021/0095901 | A1 | 4/2021 | Perez-Blanco | |

OTHER PUBLICATIONS

U.S. Appl. No. 17/189,407, filed Mar. 2, 2021, Vaisman et al.
U.S. Appl. No. 17/189,422, filed Mar. 2, 2021, Vaisman et al.
U.S. Appl. No. 17/189,430, filed Mar. 2, 2021, Vaisman et al.

* cited by examiner

THERMAL MANAGEMENT SYSTEMS

CLAIM OF PRIORITY

This application claims priority under 35 USC § 119(e) to U.S. Provisional Patent Application Ser. No. 63/047,371, filed on Jul. 2, 2020, and entitled "THERMAL MANAGEMENT SYSTEMS," the entire contents of which are hereby incorporated by reference.

BACKGROUND

This disclosure relates to refrigeration.

Refrigeration systems absorb thermal energy from heat sources operating at temperatures above the temperature of the surrounding environment, and discharge thermal energy into the surrounding environment.

Conventional refrigeration systems are closed circuit systems and include a compressor, a heat rejection exchanger (i.e., a condenser), a liquid refrigerant receiver, an expansion device, and a heat absorption exchanger (i.e., an evaporator). Such systems can be used to maintain operating temperature set points for a wide variety of cooled heat sources (loads, processes, equipment, systems) thermally interacting with the evaporator. Closed-circuit refrigeration systems may pump significant amounts of absorbed thermal energy from heat sources into the surrounding environment. In closed-circuit systems compressors are used to compress vapor from the evaporation and condensers are used to condense the vapor to cool the vapor into a liquid. The combination of condensers and compressors add significant amounts of weight and consume relatively large amounts of electrical power. In general, the larger the amount of absorbed thermal energy that the system is designed to handle, the heavier the refrigeration system and the larger the amount of power consumed during operation, even when cooling of a heat source occurs over relatively short time periods.

SUMMARY

According to an aspect, a thermal management system includes a receiver configured to store a refrigerant, the receiver having a receiver inlet and a receiver outlet, a closed-circuit refrigeration system including a vapor compression closed-circuit system that includes the receiver and further includes a first evaporator and a second evaporator, each having an inlet and an outlet, a liquid separator having an inlet, a liquid-side outlet, and a vapor-side outlet, and an ejector having a primary inlet that receives refrigerant fluid from the receiver and an outlet that delivers refrigerant fluid to the liquid separator from the outlet of the first evaporator, a closed-circuit system that includes the receiver and further includes a third evaporator having an inlet and an outlet, wherein the closed-circuit refrigeration system is configurable to receive refrigerant from the receiver through one or both of the vapor compression closed-circuit system and the closed-circuit system, and an open circuit refrigeration system having an open-circuit fluid system extending from the receiver outlet to an exhaust line.

Embodiments of the thermal management systems may include any one or more of the following features or other features disclosed herein.

The ejector further has a secondary inlet that receives refrigerant fluid from the outlet of the second evaporator. The refrigerant received at the secondary inlet is entrained by refrigerant received at the primary inlet.

The first and second evaporators of the vapor compression closed-circuit system are configured to receive the refrigerant fluid from the receiver and to extract heat from at least one heat load.

The third evaporator is configured to receive the refrigerant from the receiver and to extract heat from at least one heat load.

The closed-circuit refrigeration system further includes a compressor having a compressor inlet coupled to an outlet of the first evaporator and having a compressor outlet, the compressor configured to receive a superheated refrigerant vapor at the compressor inlet and deliver a compressed refrigerant vapor at the compressor outlet, and a condenser having a condenser inlet coupled to the compressor outlet and having a condenser outlet coupled to the inlet of the receiver, the condenser configured to condense the compressed refrigerant vapor received from the compressor.

The system further includes an expansion valve that is disposed at the first evaporator inlet and that causes an adiabatic flash evaporation of a part of refrigerant received from the receiver. The expansion valve is configurable to control a vapor quality of the refrigerant at the outlet of the first evaporator.

The closed-circuit system pumping system, and the system further includes a pump that receives refrigerant from the receiver and pumps the received refrigerant to the inlet of the third evaporator. The closed-circuit pumping system comprises the condenser, but excludes the compressor. The closed-circuit pumping system further includes a junction device having a first outlet that is coupled to the condenser inlet, and a check valve coupled between the third evaporator outlet and an inlet of the junction device.

The open-circuit refrigeration system includes a junction device having an inlet and first and second outlets, with the first outlet coupled to the compressor inlet, and with the open-circuit system including the receiver outlet, the first and second evaporators, the liquid separator and the exhaust line, and with the open-circuit refrigeration system being configurable to receive refrigerant from the receiver and controllably discharge the refrigerant without the discharged refrigerant being returned to the receiver. The open-circuit refrigeration system further includes a back-pressure regulator having an inlet coupled to the second outlet of the junction device. The open-circuit refrigeration system discharges refrigerant from the exhaust line as a vapor.

The closed-circuit pumping system further includes a fourth evaporator having an inlet configured to receive refrigerant and an outlet configured to send refrigerant towards the condenser. The closed-circuit pumping system further includes a junction device having first and second inlets and an outlet, with the outlet coupled to the condenser inlet, and a check valve having an inlet and an outlet, with the outlet coupled to the second inlet of the junction device, and with the first inlet coupled to the outlets of the third and fourth evaporators.

The system closed-circuit pumping system further includes a control valve having an inlet coupled to the outlet of the third evaporator, and having an outlet coupled to the inlet of the check valve.

The system further includes a three-way junction device having an inlet and first and second outlets, with the inlet coupled to the outlet of the receiver, the first outlet coupled to the pump inlet and the second outlet coupled to the primary inlet of the ejector. The vapor compression closed-circuit system further includes a first expansion valve having an inlet configured to receive refrigerant from the receiver and having an outlet coupled to the inlet of the first evaporator.

The refrigerant is ammonia.

According to an aspect, a thermal management method includes transporting from a receiver stored refrigerant fluid through a closed-circuit refrigeration system, with the closed-circuit refrigeration system having a vapor compression closed-circuit system that includes first and second evaporators, an ejector, a liquid separator, and the receiver, and/or transporting from the receiver stored refrigerant fluid through the closed-circuit refrigeration system, with the closed-circuit refrigeration system further having a closed-circuit system that includes the receiver and a third evaporator, and receiving refrigerant by the receiver through one or both of the vapor compression closed-circuit refrigeration system and the closed-circuit system.

Embodiments of the thermal management method may include any one or more of the following features or other features disclosed herein.

Transporting includes transporting the refrigerant fluid through the vapor compression closed-circuit system to the first and second evaporators and extracting heat from at least one heat load in proximity to each of the first and second evaporators.

Transporting includes transporting the refrigerant fluid through the closed-circuit system to the third evaporator and extracting heat from at least one heat load in proximity to the third evaporator. Transporting further includes transporting the refrigerant fluid through the closed-circuit system to the third evaporator and extracting heat from at least one heat load in proximity to the third evaporator. Transporting further includes compressing refrigerant vapor received by a compressor from a vapor side outlet of the liquid separator, with the compressor providing compressed superheated refrigerant vapor at a compressor outlet and removing heat from the compressed superheated refrigerant vapor received by a condenser coupled to the compressor outlet, with the condenser providing refrigerant fluid at a condenser outlet, and transporting the refrigerant fluid to an inlet of the receiver.

The method further includes transporting the refrigerant fluid through an expansion device that is disposed at the first evaporator inlet and causing an adiabatic flash evaporation of a part of a liquid refrigerant in the refrigerant fluid received from the receiver. The method further includes controlling a vapor quality of the refrigerant fluid at the outlet of the first evaporator by operation of the expansion device.

The closed-circuit system is a closed-circuit pumping system and the method further includes pumping received refrigerant fluid from the receiver into the third evaporator. The closed-circuit pumping system further comprises the condenser. The closed-circuit system excludes the compressor.

The method further includes receiving refrigerant fluid from the third evaporator by a junction device that has a first port coupled to the condenser inlet and a second port coupled to a check valve that is coupled to the third evaporator outlet.

The refrigerant is ammonia.

The method further includes transporting a portion of the refrigerant vapor from the first and second evaporators into an inlet of the liquid separator that has a vapor-side outlet coupled to an inlet of a junction device and transporting a portion of the refrigerant vapor from the liquid separator to a back-pressure regulator having an inlet coupled to the vapor-side outlet of the liquid separator.

The method further includes exhausting a portion of refrigerant vapor received from a vapor-side outlet of the liquid separator through a back-pressure regulator having an inlet coupled to the vapor-side outlet of the liquid separator and having an outlet coupled to an exhaust line, with exhausted refrigerant fluid not returning to the receiver. The refrigerant is ammonia and, during operation of the open-circuit refrigeration system, ammonia is discharged from the exhaust line as a vapor.

One or more of the above aspects may provide one or more of the following advantages and/or other advantages as disclosed herein.

The above aspects can be used for cooling of high temperature electronics, such as batteries without upsizing compressor. Upsizing a compressor in a conventional closed-circuit system in order to cool the high temperature heat load, e.g., the battery at the same evaporating temperature would most likely require a bigger and heavier compressor and a bigger and heavier overall conventional closed-circuit system.

The details of one or more embodiments are set forth in the accompanying drawings and the description below. Other features and advantages will be apparent from the description, drawings, and claims.

DETAILED DESCRIPTION

Figure 1:
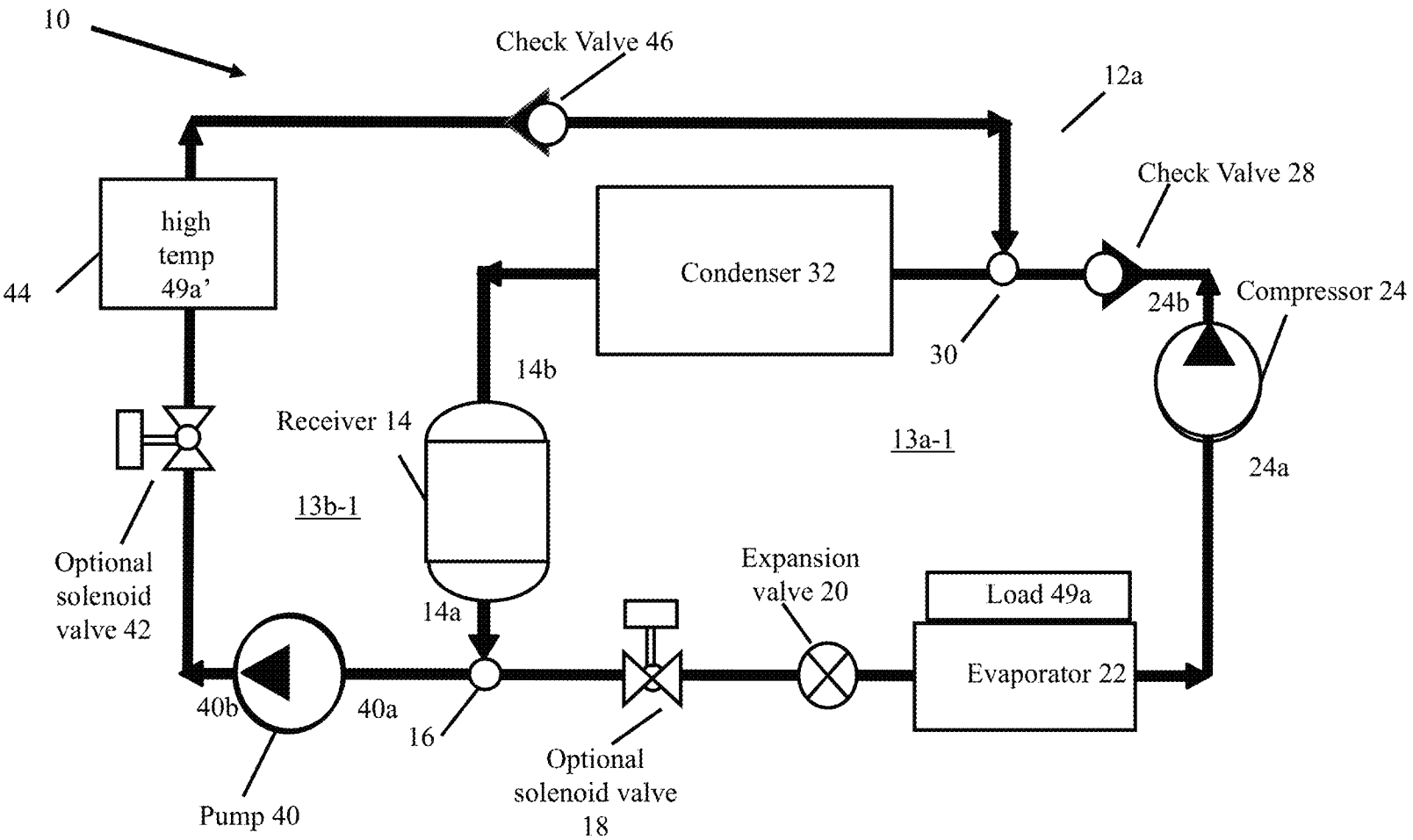
FIG. 1 is a schematic diagram of a thermal management system that includes a multi-evaporator closed-circuit refrigeration system with pump closed-circuits and vapor-compressed closed-circuits.

I. General Introduction Cooling of large loads and high heat flux loads that are also highly temperature sensitive can present a number of challenges. On the one hand, such loads generate significant quantities of heat that is extracted during cooling. In conventional closed-circuit refrigeration systems, cooling high heat flux loads typically involves circulating refrigerant fluid at a relatively high mass flow rate. However, closed-circuit system components that are used for refrigerant fluid circulation—including large compressors to compress vapor at a low pressure to vapor at a high pressure and condensers to remove heat from the compressed vapor at the high pressure and convert to a liquid—are typically heavy and consume significant power. As a result, many closed-circuit systems are not well suited for deployment in mobile platforms, such as on small vehicles or in space, where size and weight constraints may make the use of large compressors and condensers impractical.

On the other hand, temperature sensitive loads such as electronic components and devices may require temperature regulation within a relatively narrow range of operating temperatures. Maintaining the temperature of such a load to within a small tolerance of a temperature set point can be challenging when a single-phase refrigerant fluid is used for heat extraction, since the refrigerant fluid itself will increase in temperature as heat is absorbed from the load.

Directed energy systems that are mounted to mobile vehicles, such as trucks, or that exist in space may present many of the foregoing operating challenges, as such systems may include high heat flux and temperature sensitive components that require precise cooling during operation in a relatively short time. The thermal management systems disclosed herein, while generally applicable to the cooling of a wide variety of thermal loads, are particularly well suited for operation with such directed energy systems.

In some cases, a thermal management system may be specified to cool two different kinds of heat loads—high heat loads (high heat flux, highly temperature sensitive components) operative for short periods of time and low heat loads (relative to the high heat loads) operative continuously or for relatively long periods (relative to the high heat loads). However, to specify a refrigeration system for the high thermal load may result in a relatively large and heavy refrigeration system with a concomitant need for a large and heavy power system to sustain operation of the refrigeration system.

Such systems may not be acceptable for mobile applications. Also, start-up and/or transient processes may exceed the short period in which cooling duty is applied for the high heat loads that are operative for short periods of time. Transient operation of such systems cannot provide precise temperature control. Therefore, thermal energy storage (TES) units are integrated with small refrigeration systems and recharging of such TES units are used instead. Still TES units may be too heavy and too large for mobile applications. In addition, such systems are complex devices and reliability may present problems especially for critical applications.

The thermal management systems and methods disclosed herein include a number of features that reduce both overall size and weight relative to conventional refrigeration systems, and still extract excess heat energy from both high heat flux, highly temperature sensitive components and relatively temperature insensitive components, to accurately match temperature set points for the components.

At the same time, the disclosed thermal management systems that use a compressor would, in general, require less power than conventional closed-circuitry systems for a given amount of refrigeration over a specified period(s) of operation. While certain conventional refrigeration systems can use closed-circuit refrigerant flow paths, the systems and methods disclosed herein use modified closed-circuit refrigerant flow paths and the modified closed-circuit refrigerant flow paths in combination with open-circuit refrigerant flow paths to handle a variety of heat loads. Depending upon the nature of the refrigerant fluid, exhaust refrigerant fluid may be incinerated as fuel, chemically treated, and/or simply discharged at the end of the flow path.

II. Thermal Management Systems with Multi-Evaporators

Referring now to FIG. 1, a thermal management system (TMS) 10 includes a multi-evaporator closed-circuit refrigeration system (M-ECCRS) 12*a* that cools a high temperature load and a low temperature load (relative to the high temperature load). The M-ECCRS 12*a* includes two interacting circuits, a vapor compression closed-circuit refrigeration system 13*a*-1 and a closed-circuit pumping system 13*b*-1. The vapor compression closed-circuit refrigeration system 13*a*-1 is configured to cool heat loads 49*a* at a low heat load temperature below the condensation temperature of a refrigerant vapor, whereas the closed-circuit pumping system 13*b*-1 cools heat loads that are at a high temperature, e.g., high temperature heat loads 49*a*', which are at a temperature that is equal to or above the condensation temperature of the refrigerant vapor. Examples of high temperature heat loads are batteries and various electronic and mechanical devices.

The vapor compression closed-circuit refrigeration system 13*a*-1 includes a receiver 14 that has a receiver outlet 14*a* coupled to an inlet of a junction device 16. The receiver 14 further has a receiver inlet 14*b* and the receiver 14 is configured to store refrigerant fluid. The junction device 16 has an outlet that is coupled to an inlet of an optional solenoid control valve 18. The optional solenoid control valve 18 has an outlet that is coupled to an inlet of a control device, such as an expansion valve 20. The optional solenoid control valve 18 can be used when the expansion valve 20 is not configured to completely stop refrigerant flow when the TMS 10 is in an off state. The expansion valve 20 has an outlet that is coupled to an inlet of a vapor-circuit evaporator (evaporator) 22. The evaporator 22 has an outlet that is coupled to a compressor inlet 24*a* of a compressor 24. The compressor 24 has an outlet 24*b* that is coupled through a check valve 28 to an inlet of a second junction device 30. The second junction device 30 has an outlet that is coupled to an inlet of a condenser 32 and the condenser 32 has an outlet that is coupled to the receiver inlet 14*a*. Conduit couples the aforementioned devices, as shown.

The condenser 32 of the vapor compression closed-circuit refrigeration system 13*a*-1 can be air cooled, water cooled, or use any cooling fluid available in the vehicle or station where the system is installed. Not shown is an optional bypass coupled between the receiver inlet and the inlet to a second evaporator. The bypass could include a control valve and two additional junctions.

The closed-circuit pumping system 13*b*-1 includes the receiver 14 and the junction device 16 that has a second outlet coupled to an inlet 40*a* of a pump 40. An outlet 40*b* of the pump 40 is coupled to an optional solenoid control valve 42 that is coupled to a closed-circuit evaporator 44 that houses a high temperature heat load 49*a*', e.g. a battery, electronic circuits, etc., to be cooled. From the outlet of the closed-circuit evaporator 44 refrigerant fluid passes to an inlet of a second check valve 46 and back to a second inlet of the second junction device 30 and onto the inlet of the condenser 32. Conduit couples the aforementioned devices, as shown.

Normally, the evaporator 22 of the vapor compression closed-circuit refrigeration system 13*a*-1 generates a superheat at the exit thereof. The expansion valve 20 can be configured to control vapor quality, discussed below, at the evaporator outlet. Alternatively an ejector or a pump can be used to control vapor quality, as will be discussed below. The vapor compression closed-circuit refrigeration system 13*a*-1 with a liquid recirculating pump can be configured to control two-phase (or superheated) refrigerant states exiting the evaporator 22.

In some embodiments, the pump 40 is a variable speed or multi-speed pump. The TMS 10 may implement several methods of temperature control. For example, in one method of temperature control involves varying the speed of the pump 40, e.g., the variable speed or multi-speed pump. Another example involves modulating a control valve (not shown) on the main line from the receiver 14. Various combinations of the above examples can also be used.

In some implementations of the vapor compression closed-circuit refrigeration systems discussed herein, such as vapor compressor closed-circuit refrigeration system 13*a*-1, an oil is used for lubrication of the compressor 24.

An advantage of the TMS 10 involves cooling of electronics, such as batteries, which can be implemented without upsizing the compressor 24. Upsizing a compressor in a conventional closed-circuit system in order to cool the high temperature heat load 49*a*', e.g., the battery at the same evaporating temperature would most likely require a bigger and heavier compressor and a bigger and heavier overall conventional closed-circuit system.

A. Closed-Circuit Refrigeration Operation

When the low temperature heat load 49*a* is active, the TMS 10 is configured to have the vapor compression closed-circuit refrigeration system 13*a*-1 provide refrigeration to the low temperature heat load 49*a*. In this instance, a controller 17 (shown in FIG. 18) produces signals to open solenoid control valve 18 (if used). In the vapor compression closed-circuit refrigeration system 13*a*-1, circulating refrigerant enters the compressor 24 as a saturated or superheated vapor and is compressed to a higher pressure at a higher temperature (a superheated vapor). This superheated vapor is at a temperature and pressure at which it can be condensed in the condenser 32 by either cooling water or cooling air flowing across a coil or tubes in the condenser 32. At the condenser 32, the circulating refrigerant loses heat and thus removes heat from the TMS 10, which removed heat is carried away by either water or air (whichever may be the case) flowing over the coil or tubes, providing a condensed, sub-cooled liquid refrigerant.

The condensed, sub-cooled liquid refrigerant is routed into the receiver 14, and exits the receiver 14, as a high pressure, sub-cooled liquid refrigerant that enters the expansion valve 20 (through the optional solenoid control valve 18, if used.) The high pressure, sub-cooled liquid refrigerant is enthalpically expanded in the expansion valve 20 and the high pressure, sub-cooled liquid refrigerant turns into a liquid-vapor mixture at a low pressure and temperature. The temperature of the liquid and vapor refrigerant mixture (evaporating temperature) is lower than the temperature of the low heat load 49*a*. The mixture is routed through a coil or tubes in the evaporator 22.

The heat from the low temperature heat load 49*a*, in contact with or proximate to the evaporator 22, partially (provided that another mechanism is used to ensure that liquid does not enter the compressor inlet 24*a*) or completely evaporates the liquid portion of the two-phase refrigerant mixture, and superheats the mixture. The saturated or superheated refrigerant vapor leaves the evaporator 22 and enters the compressor 24. If the evaporator 22 operates in a threshold of vapor quality, a suction accumulator 62 (FIG. 4) captures liquid and slowly returns it back into the suction line. Compressed vapor exits the compressor 24, passes though the check valve 28, and enters the junction 30. The evaporator 22 is where the circulating refrigerant absorbs and removes heat from the applied low heat load 49*a*, which heat is subsequently rejected in the condenser 32 and transferred to an ambient by water or air used in the condenser 32.

When the high temperature heat load 49*a*' is active, the closed-circuit pumping system 13*b*-1 operates by turning the pump 40 on, which causes refrigerant from the receiver 14 to be pumped by the pump 40 through the optional solenoid control valve 42 (that is also open) into the inlet of the closed-circuit evaporator 44 that has the high temperature heat load 49*a*', e.g., the battery for high temperature cooling. Heat from the high temperature heat load 49*a*' is removed into the refrigerant liquid and the refrigerant liquid carries the heat through the check valve 46 into the junction 30 and to the condenser inlet 32. The closed-circuit evaporator 44 is where the circulating refrigerant absorbs and removes heat from the battery heat load 49*a*', which heat is subsequently rejected in the condenser 32, and transferred to an ambient by water or air used in the condenser 32.

Figure 2:
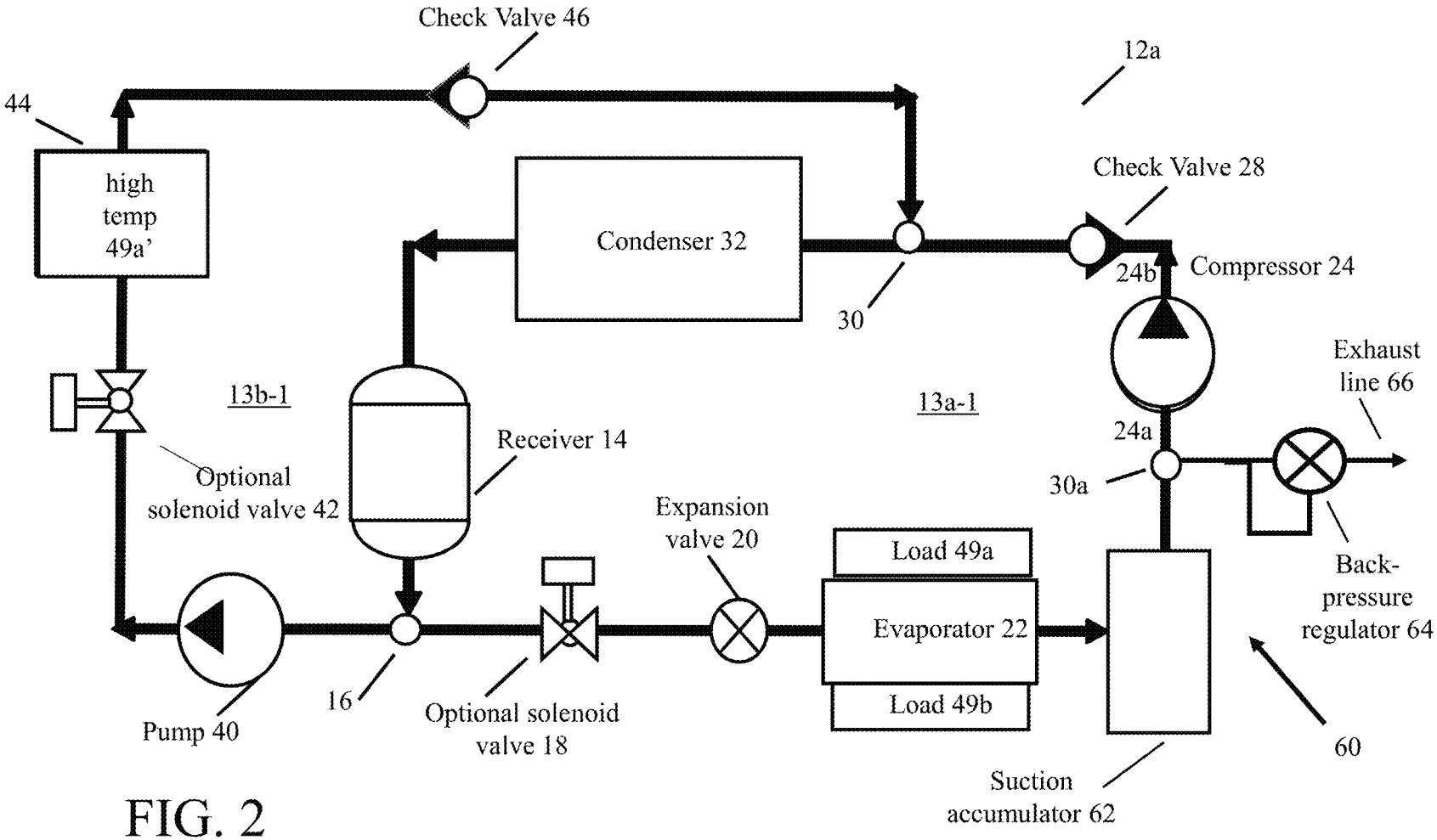
FIG. 2 is a schematic diagram showing the thermal management system of FIG. 1 including an open-circuit refrigeration system.

Referring to FIG. 2, another example of the TMS 10 includes the M-ECCRS 12*a* of FIG. 1 that is integrated with an open-circuit refrigeration system. TMS 10 provides closed-circuit refrigeration for a high temperature load 49*a*' and a low temperature load 49*a* (relative to the high temperature load 49*a*') over long time intervals, while the open-circuit refrigeration system provides open-circuit refrigeration of a high heat load 49*b* over short time intervals (relative to the interval of refrigeration of the low heat load 49*a*).

The M-ECCRS portion 12*a* includes the vapor compression closed-circuit refrigeration system 13*a*-1 and the closed-circuit pumping system 13*b*-1, as discussed above for FIG. 1. The vapor compression closed-circuit refrigeration system 13*a*-1 includes the receiver 14, the junction 16, optional solenoid control valve 18, the expansion valve 20, and an evaporator arrangement 22, with detailed examples shown in FIGS. 2A-2D. Also included are the compressor 24 and the condenser 32, which are coupled via the junction 30 and the check valve 28. The outlet of the condenser 32 is coupled to the inlet of the receiver 14.

The closed-circuit pumping system 13*b*-1 includes the receiver 14, the junction device 16 and the pump 40. The outlet of the pump 40 is coupled to the optional solenoid control valve 42 that is coupled to the closed-circuit evaporator 44 that houses the high temperature heat load 49*a*' to be cooled. From the outlet of the closed-circuit evaporator 44 refrigerant fluid passes to the inlet of the second check valve 46 and back to the second inlet of the second junction device 30 to the inlet of the condenser 32. Conduit couples the aforementioned devices, as shown.

In some implementations of the TMS 10 an oil is used for lubrication of the compressor 24. The oil is removed from the refrigerant to be recirculated back to the compressor 24. The oil can be removed from the inlet of a suction accumulator 62, within the suction accumulator or elsewhere within the vapor compressor closed-circuit refrigeration system 13*a*-1. The vapor compressor closed-circuit refrigeration system 13*a*-1 has a mechanism to return oil from the suction accumulator 62 and may include an oil separator (not shown).

The high heat load 49*b* is managed as follows.

If the heat load temperatures of the high heat load 49*b* can be maintained over a wide range, the closed-circuit refrigeration operates until the temperature of the high heat load 49*b* reaches a high temperature limit of the range. When there is a need to further cool the high heat load 49*b*, the controller 17 sends a signal to controllably open the back pressure regulator 64 and engage the open-circuit. This strategy can reduce the amount of exhausted refrigerant.

Also shown in FIG. 2 is the open-circuit refrigeration system (OCRS) 60. The OCRS 60 includes the suction accumulator 62, a junction device 30*a*, a back-pressure regulator 64, and an exhaust line 66 in addition to the receiver 14, the optional solenoid control valve 18, expansion device 20 and the evaporator 22.

A. Closed-Circuit Refrigeration Operation

The M-ECCRS 12*a* operates as discussed in FIG. 1, above, except that the back-pressure regulator 64 is off, and the suction accumulator 62 is interposed between the outlet of the evaporator 22 and the inlet 24*a* of the compressor 24. Refrigerant from the outlet of the evaporator 22 is fed into the suction accumulator 62, and refrigerant vapor is removed from the suction accumulator 62 into the compressor inlet 24*a*.

B. Open/Closed-Circuit Refrigeration Operation

On the other hand, when a high heat load 49*b* is applied, a mechanism such as the controller 17 causes the TMS 10 to operate in both a closed and open-circuit configuration.

The closed-circuit portion is similar to that described above, the evaporator 22 in this case may operate within a threshold of a vapor quality, (e.g., the evaporator 22 may operate with a superheat or in two-phase (provided that the suction accumulator 62 captures incidental non-evaporated liquid). The suction accumulator 62 receives the two-phase mixture, and delivers saturated vapor to the compressor 24.

When the closed-circuit portion operates with the open-circuit enabled, the controller 17 is configured to cause the back-pressure regulator 64 to be placed in an ON position, thus opening the back-pressure regulator 64 to permit the back-pressure regulator 64 to exhaust excessive vapor formed by the high heat load 49*b* through the exhaust line 66. The back-pressure regulator 64 maintains a back-pressure at an inlet to the back-pressure regulator 64, according to a set point pressure, while allowing the back-pressure regulator 64 to exhaust refrigerant vapor through the exhaust line 66. Exhausted refrigerant vapor is not returned to the receiver 14.

When the load 49*b* is applied and excessive amount of vapor is formed, the vapor pressure in the evaporator 22 is raised. The back pressure regulator 64 can be configured to automatically respond to this pressure rise. When the load 49*b* is off, the amount of vapor formed in the evaporator 22 is abruptly reduced, and the vapor pressure is reduced as well, and the back-pressure regulator 64 automatically closes with no signal sent from the controller 17.

The open-circuit portion operates like a thermal energy storage (TES) system, increasing cooling capacity of the TMS 10 when a pulsing heat load (e.g., high heat load 49*b*) is activated, but without a duty cycle cooling penalty commonly encountered with TES systems, (particularly, low latent heat of the phase change material, poor thermal conductivity of the phase change material, heavy structure mitigating the poor thermal conductivity phase change material, use a secondary fluid to cool and melt the phase change material, etc.). The cooling duty is executed without the concomitant penalty of conventional TES systems provided that the receiver 14 has enough refrigerant charge and the refrigerant flow rate flowing through the evaporator 22 matches the rate needed by the high heat load 49*b*. The back-pressure regulator 64 exhausts the refrigerant vapor less the refrigerant vapor recirculated by the compressor 24. The rate of exhaust of the refrigerant vapor through the exhaust line 66 is governed by the set point pressure used at the input to the back-pressure regulator 64.

When the high heat load 49*b* is no longer in use or its temperature is reduced, this occurrence is sensed by a sensor (not shown) and a signal from the sensor (or otherwise, such as communicated directly by the high heat load 49*b*) is sent to the controller 17. The controller 17 is configured to partially or completely close the back-pressure regulator 64 by changing the set point pressure (or otherwise), partially or totally closing the exhaust line 66 to reduce or cut off exhaust refrigerant flow through the exhaust line 66. When the high heat load 49*b* reaches a desired temperature or is no longer being used, the back-pressure regulator 64 is placed in the OFF status and is thus closed, and closed-circuit portion continues to operate, as needed.

FIGS. 2A-2D illustrate specific configurations for the evaporator arrangement (also referred to herein as evaporator 22) and heat loads 49*a*, 49*b*. Each of these specific configurations are generally applicable to the various embodiments discussed herein. As will be used herein, evaporator arrangement includes any of the specific configurations mentioned. In addition, when used herein "evaporator" can referred to as an evaporator arrangement as well unless otherwise specifically noted.

Figure 2A:
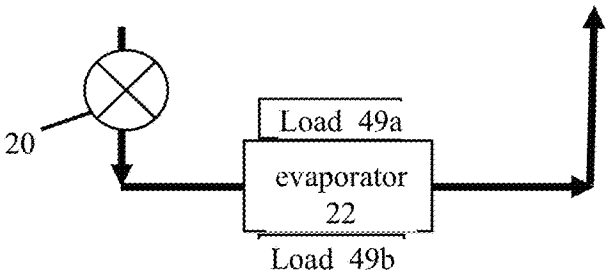
FIGS. 2A-2D are schematic diagrams showing alternative configurations for arrangement of evaporators/loads on the integrated open-circuit/closed-circuit refrigeration system, generally applicable to described embodiments.

In the configuration of FIG. 2A, both the low heat load 49*a* and the high heat load 49*b* are coupled to (or are in proximity to) a single, i.e., the same, evaporator 22.

Figure 2B:
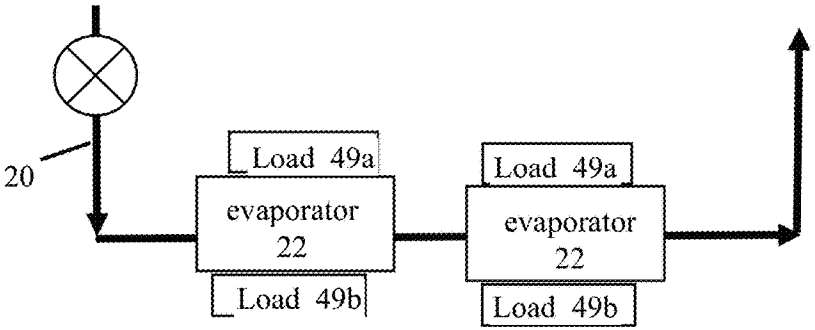

In the configuration of FIG. 2B, each of a pair of evaporators (generally 22) have the low temperature heat load 49*a* and the high heat load 49*b* coupled or proximate thereto. In an alternative configuration of FIG. 2B, (not shown), the low heat load 49*a* would be coupled (or proximate) to a first one of the pair of evaporators (generally 22) and the high heat load 49*b* would be coupled (or proximate) to a second one of the pair of evaporators (generally 22).

Figure 2C:
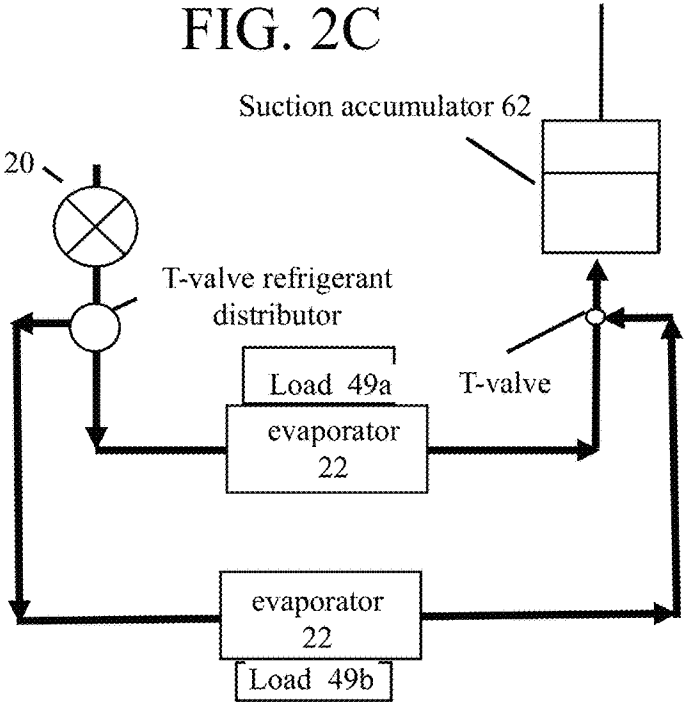
Figure 2D:
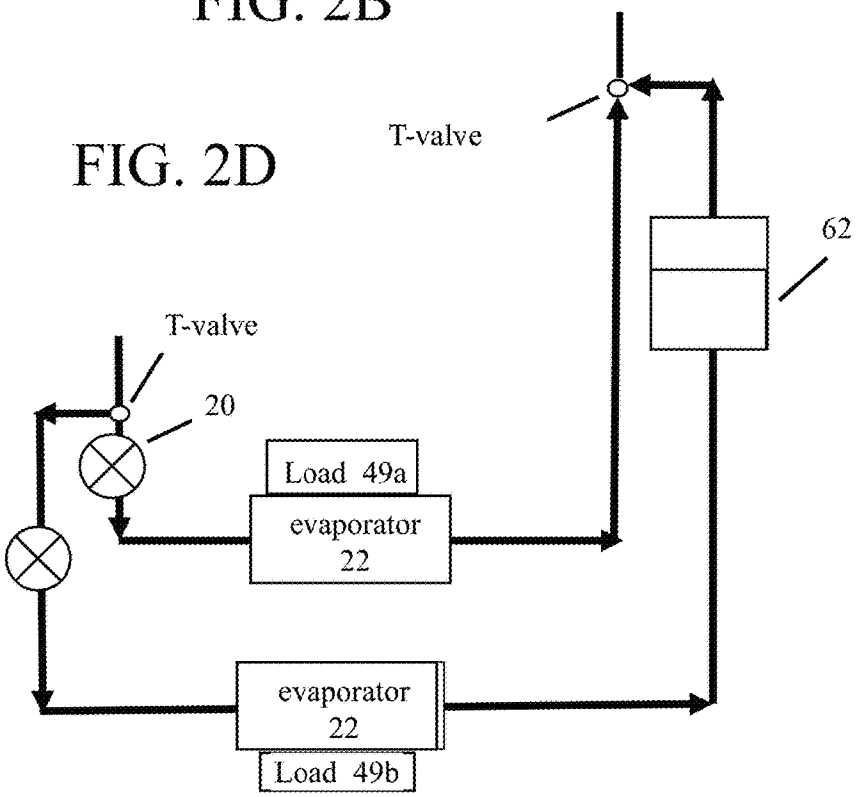

In the configurations of FIGS. 2C and 2D, the low heat load 49*a* and the high heat load 49*b* are coupled (or proximate) to corresponding ones of the pair of evaporators (generally 22). In the configuration of FIG. 2C a refrigerant distributor is used to split two-phase refrigerant coming from the expansion valve 20. (This is typical distributors supplied by Danfoss, Sporlan, and other refrigerant manufacturers). In the configuration of FIG. 2D, a T-valve splits a single phase refrigerant flow from the receiver 14 into two paths that feed two evaporators (generally 22). One of these evaporators 22 is coupled (or proximate) to the low heat load

49*a* and the other of these evaporators 22 is coupled (or proximate to) the high heat load 49*b*. As also shown in FIG. 2D expansion valves are coupled at inlet sides of the evaporators 22. At least one expansion valve would be configured to control a vapor quality at the evaporator 22 exit to allow discharging liquid into the suction accumulator 62, while the other would control a superheat. Other configurations are possible.

In the configuration of FIG. 2C, the outputs of the evaporators (generally 22) are coupled via conduits to a second T-valve (active or passive) that has an output that feeds the inlet of the suction accumulator 62.

On the other hand, in the configuration of FIG. 2D, the outputs of the evaporators (generally 22) are coupled differently. The output of the evaporator 22 that has low heat load 49*a* feeds an inlet of the T-valve (a T-fitting or junction), whereas the output of the evaporator 22 that has high heat load 49*b* feeds an inlet of the suction accumulator 62. This arrangement, in effect, removes the suction accumulator from the vapor compression closed-circuit refrigeration system 13*a*-1. In some configurations, the T valves can be switched (meaning that they can be controlled (automatically or manually) to shut off either or both inlets) or passive meaning that they do not shut off either inlet and thus can be T junctions.

The provision of the vapor compression closed-circuit refrigeration system 13*a*-1 helps to reduce amount of exhausted refrigerant. The TMS 10 uses the compressor 24 to save ammonia, and in general it may not be desirable to shut the compressor 24 off. For instance, the compressor 24 can help to keep a high pressure in the receiver 14 if a head pressure control valve is applied.

On the other hand, in some embodiments, the TMS 10 could be configured to operate in modes where the compressor 24 is turned off and the TMS 10 operates in open-circuit mode only (such as in fault conditions in the circuit or cooling requirements).

The TMS 10 would generally also include the controller 17 (see FIG. 18 for an exemplary embodiment) that produces control signals (based on sensed thermodynamic properties) to control operation of the various ones of devices 18, 20, etc., as needed, as well as the compressor 24, pump 40 and back-pressure regulator 64. Controller 17 may receive signals, process received signals and send signals (as appropriate) from/to the expansion valve 20, the optional solenoid control valve 18, and a motor of the compressor 24 changing its speed, shutting compressor 24 off or starting it, etc.

As used herein the compressor 24 is, in general, a device that increases the pressure of a gas by reducing the gas' volume. Usually, the term compressor refers to devices operating at and above ambient pressure, (some refrigerant compressors may operate inducing refrigerant at pressures below ambient pressure, e.g., desalination vapor compression systems employ compressors with suction and discharge pressures below ambient pressure).

In general, the solenoid control valve 18 includes a solenoid that uses an electric current to generate a magnetic field to control a mechanism that regulates an opening in a valve to control fluid flow. The solenoid control valve 18 is configurable to stop refrigerant flow as an on/off valve, if the expansion valve 20 cannot shut off fluid flow robustly.

Expansion valve 20 functions as a flow control device and in particular as a refrigerant expansion valve device. In general, expansion valve 20 can be implemented as any one or more of a variety of different mechanical and/or electronic devices. For example, in some embodiments, expansion valve 20 can be implemented as a fixed orifice, a capillary tube, and/or a mechanical or electronic expansion valve. In general, fixed orifices and capillary tubes are passive flow restriction elements which do not actively regulate refrigerant fluid flow.

Mechanical expansion valves (usually called thermostatic or thermal expansion valves) are typically flow control devices that enthalpically expand a refrigerant fluid from a first pressure to an evaporating pressure, controlling the superheat at the evaporator exit. Mechanical expansion valves generally include an orifice, a moving seat that changes the cross-sectional area of the orifice and the refrigerant fluid volume and mass flow rates, a diaphragm moving the seat, and a bulb at the evaporator exit. The bulb is charged with a fluid and it hermetically fluidly communicates with a chamber above the diaphragm. The bulb senses the refrigerant fluid temperature at the evaporator exit (or another location) and the pressure of the fluid inside the bulb transfers the pressure in the bulb through the chamber to the diaphragm and moves the diaphragm and the seat to close or to open the orifice.

Typical electrically controlled expansion valves include an orifice, a moving seat, a motor or actuator that changes the position of the seat with respect to the orifice, a controller, and pressure and temperature sensors at the evaporator exit.

Examples of suitable commercially available expansion valves that can function as expansion valve 20 include, but are not limited to, thermostatic expansion valves available from the Sporlan Division of Parker Hannifin Corporation (Washington, Mo.) and from Danfoss (Syddanmark, Denmark).

The controller 17 calculates the superheat for the expanded refrigerant fluid based on pressure and temperature measurements at the evaporator exit. If the superheat is above a set-point value, the seat moves to increase the cross-sectional area and the refrigerant fluid volume and mass flow rates to match the superheat set-point value. If the superheat is below the set-point value, the seat moves to decrease the cross-sectional area and the refrigerant fluid flow rates. The controller 17 may be configured to control vapor quality at the evaporator exit as disclosed below.

Figure 3:
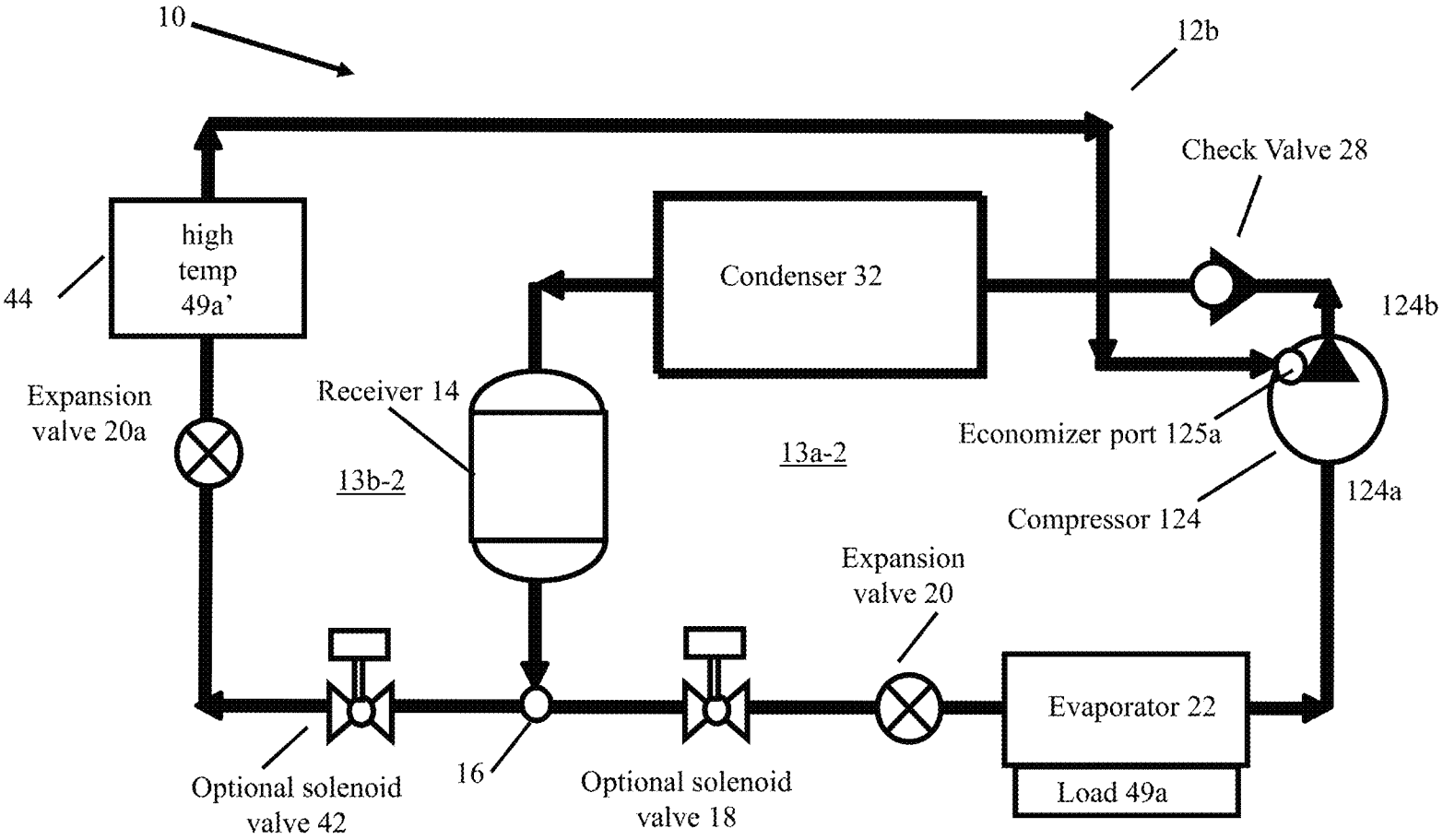
FIG. 3 is a schematic diagram of a thermal management system that includes a multi-evaporator closed-circuit refrigeration system with a vapor compression closed-circuit refrigeration system and a closed-circuit system.

Referring now to FIG. 3, the TMS 10 is shown to include an alternative M-ECCRS 12*b* that cools a high temperature load and a low temperature load (relative to the high temperature load). The M-ECCRS 12*b* includes two interacting circuits, a vapor compression closed-circuit refrigeration system 13*a*-2 and a closed-circuit system 13*b*-2.

The vapor compression closed-circuit refrigeration system 13*a*-2 is configured to cool heat loads at a low heat load temperature below the condensation temperature, whereas the closed-circuit system 13*b*-2 cools heat loads at a high temperature that is below the condensation temperature. Examples of high temperature heat loads are batteries and various electronic and mechanical devices.

The vapor compression closed-circuit refrigeration system 13*a*-2 includes features of FIG. 1, such as the receiver 14 that has the receiver outlet coupled to the inlet of the junction device 16. The junction device 16 has the outlet that is coupled to the inlet of the optional solenoid control valve 18. The optional solenoid control valve 18 has an outlet that is coupled to the inlet of the expansion valve 20. The expansion valve 20 has an outlet that is coupled to the inlet of the evaporator 22. The evaporator 22 has the outlet that is coupled to a compressor inlet 124*a* of an economizer compressor 124. Economizer compressor 124 is a compressor with an economizer port 125*a*. The compressor 124 has an outlet 124*b* that is coupled through the check valve 28 to the inlet of the condenser 32 and the condenser 32 has an outlet that is coupled to an inlet of the receiver 14. Conduit couples the aforementioned devices, as shown.

Normally, the evaporator 22 of the vapor compression closed-circuit refrigeration system 13*a*-2 generates a superheat at the exit thereof. The condenser 32 of the vapor compression closed-circuit refrigeration system 13*a*-2 can be air cooled, water cooled, or use any cooling fluid available in the vehicle or station where the system is installed.

The closed-circuit system 13*b*-2 includes the receiver 14 and the junction device 16 that has a second outlet coupled to an inlet of an optional solenoid valve 42. The outlet of the optional solenoid control valve 42 is coupled to an inlet of a second expansion valve 20*a* that has an outlet coupled to an inlet of a closed-circuit evaporator 44 that is coupled to or in proximity to the high temperature heat load 49*a*' to be cooled. From the outlet of the closed-circuit evaporator 44 refrigerant fluid passes into the economizer port 125*a* of the compressor 124. Conduit couples the aforementioned devices, as shown.

A. Closed-Circuit Refrigeration Operation

When the low heat load 49*a* is applied, the TMS 10 is configured to have the vapor compression closed-circuit refrigeration system 13*a*-2, providing refrigeration to the low heat load 49*a*.

In the vapor compression closed-circuit refrigeration system 13*a*-2, circulating refrigerant enters the compressor 124 as a saturated or superheated vapor and is compressed to a higher pressure at a higher temperature (a superheated vapor). This superheated vapor is at a temperature and pressure at which it can be condensed in the condenser 32 by either cooling water or cooling air flowing across a coil or tubes in the condenser 32. At the condenser 32, the circulating refrigerant loses heat and thus removes heat from the system, which removed heat is carried away by either water or air (whichever may be the case) flowing over the coil or tubes, providing a condensed liquid refrigerant.

The condensed and sub-cooled liquid refrigerant is routed into the receiver 14, exits the receiver 14, and enters the expansion valve 20 (through the optional solenoid control valve 18, if used.) The refrigerant is enthalpically expanded in the expansion valve 20 and the high pressure sub-cooled liquid refrigerant turns into liquid-vapor mixture at a low pressure and temperature. The temperature of the liquid and vapor refrigerant mixture (evaporating temperature) is lower than the temperature of the low heat load 49*a*. The mixture is routed through a coil or tubes in the evaporator 22.

The heat from the low heat load 49*a*, in contact with or proximate to the evaporator 22, partially or completely, evaporates the liquid portion of the two-phase refrigerant mixture, and may superheat the mixture. The refrigerant leaves the evaporator 22 and enters the compressor 124. The saturated or superheated vapor exits the compressor 124, passes though the check valve 28 and enters the condenser 32. The evaporator 22 is where the circulating refrigerant absorbs and removes heat from the applied low heat load 49*a*, which heat is subsequently rejected in the condenser 32 and transferred to an ambient by water or air used in the condenser 32.

Meanwhile, the closed-circuit system 13*b*-2 operates as follows: The solenoid control valve 42 (if used) is turned on causing refrigerant liquid from the receiver 14 to travel through the optional solenoid control valve 42 into the expansion valve 20*a* and from the expansion valve 20*a* into the closed-circuit evaporator 44 that cools, e.g., the battery. Heat from the high temperature heat load 49*a*', e.g., a battery, is removed into the circulating refrigerant and the circulating refrigerant carries the heat to the economizer port 125*a* of the compressor 124. The economizer port 125*a* allows input of vapor at an intermediate pressure that is below the discharge pressure of compressor 124 and above the suction pressure of the compressor 124. The closed-circuit evaporator 44 is where the circulating refrigerant absorbs and removes heat from the high temperature heat load 49*a*', which heat is subsequently rejected in the condenser 32, and transferred to an ambient by water or air used in the condenser 32.

Figure 4:
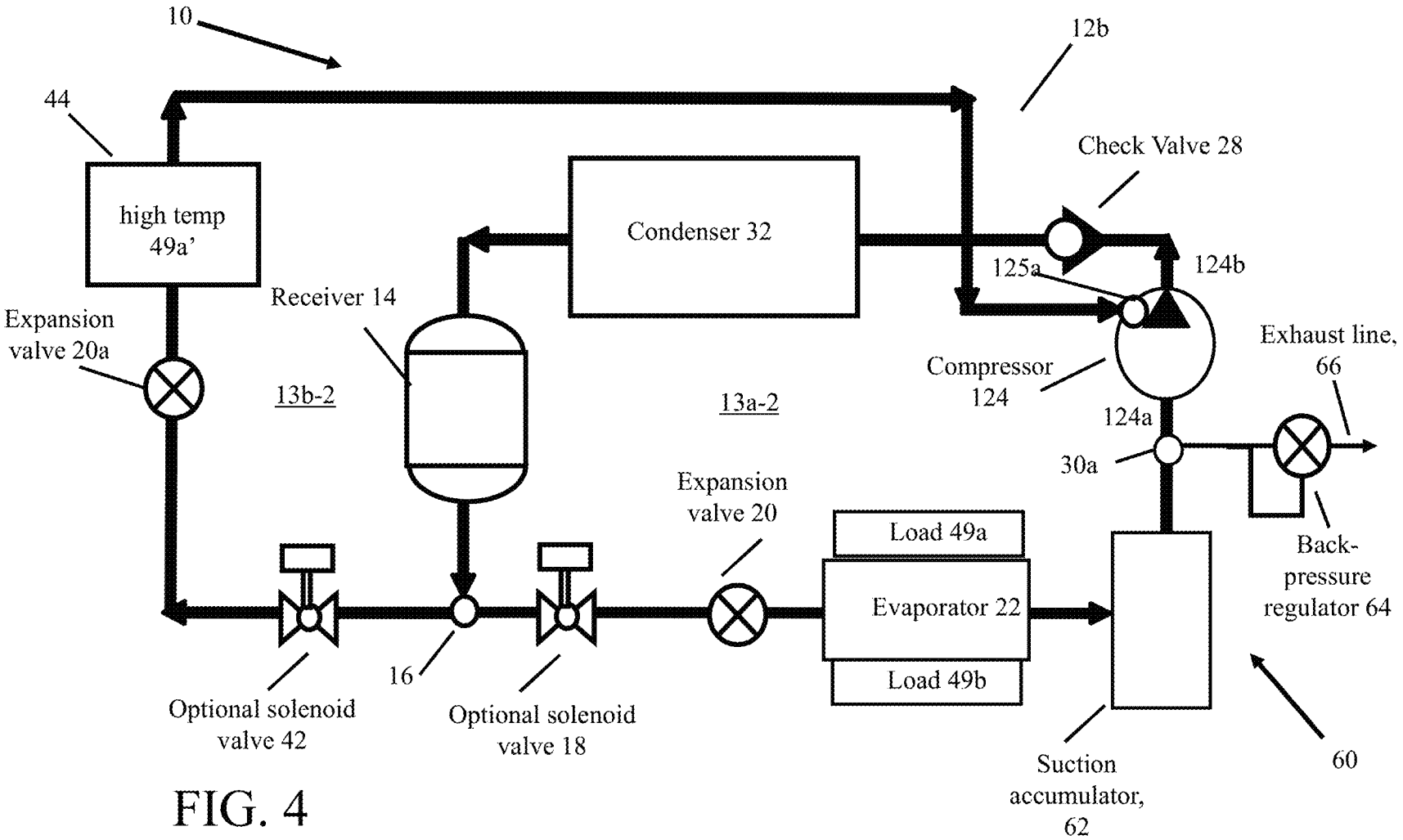
FIG. 4 is a schematic diagram showing the thermal management system of FIG. 3 including an open-circuit refrigeration system.

Referring to FIG. 4, another example of the TMS 10 that includes an open-circuit refrigeration system 60 integrated with the M-ECCRS 12*b* of FIG. 3, is shown. TMS 10 of FIG. 4 provides closed-circuit refrigeration for low heat loads 49*a* and high temperature heat loads 49*a*' over long time intervals and open-circuit refrigeration for refrigeration of high heat loads 49*b* over short time intervals (relative to the interval of refrigeration of low heat load 49*a*).

The M-ECCRS 12*b* includes the vapor compression closed-circuit refrigeration system 13*a*-2 and the closed-circuit pumping system 13*b*-2, as discussed in FIG. 3. The vapor compression closed-circuit refrigeration system 13*a*-2 includes the receiver 14, the junction 16, optional solenoid valve 18, the expansion valve 20, an evaporator arrangement 22 (evaporator 22). Also included are the compressor 124 and the condenser 32, which are coupled by the check valve 28. The outlet of the condenser 32 is coupled to the inlet of the receiver 14.

The closed-circuit pumping system 13*b*-2 includes the receiver 14, the junction device 16, the optional solenoid control valve 42 and the expansion valve 20*a* that is coupled to the closed-circuit evaporator 44 that houses a high temperature heat load 49*a*' to be cooled. From the outlet of the closed-circuit evaporator 44 refrigerant fluid passes to the economizer inlet 125*a* of the condenser 124. Conduit couples the aforementioned devices, as shown.

Also shown in FIG. 4 is the open-circuit refrigeration system 60. The open-circuit refrigeration system 60 includes the suction accumulator 62, the back-pressure regulator 64, and the exhaust line 66 in addition to the receiver 14, optional solenoid control valve 18, expansion valve 20 and evaporator 22.

A. Closed-Circuit Refrigeration Operation

The closed-circuit refrigeration system 13*b*-2 operates as discussed in FIG. 3 above, except that the back-pressure regulator 64 is off, and the suction accumulator 62 is interposed between the outlet of the evaporator 22 and the inlet 124*a* of the compressor 124. Refrigerant from the outlet of the evaporator 22 is fed into the suction accumulator 62, and refrigerant vapor is removed from the suction accumulator 62 into the compressor inlet.

B. Open/Closed-circuit Refrigeration Operation

On the other hand, when the high heat load 49*b* is active, a mechanism such as the controller 17 causes the TMS to operate in both a closed and open-circuit configuration.

The closed-circuit portion is similar to that described above, except that the evaporator 22 in this case may operate within a threshold of a vapor quality (provided that the suction accumulator 62 or another mechanism is provided to capture incidental non-evaporated liquid), or the evaporator 22 may operate with a superheat. The suction accumulator 62 receives two-phase or superheated mixture, and the compressor 124 receives saturated vapor from the suction accumulator 62.

When the closed-circuit portion operates with the open cycle, this causes the controller 17 to be configured to cause the back-pressure regulator 64 to be placed in an ON position, thus opening the back-pressure regulator 64 to permit the back-pressure regulator 64 to exhaust vapor through the exhaust line 66. The back-pressure regulator 64 maintains a back-pressure at an inlet to the back-pressure regulator 64, according to a set point pressure, while allowing the back-pressure regulator 64 to exhaust refrigerant vapor through the exhaust line 66.

The open-circuit portion operates like a thermal energy storage (TES) system, increasing cooling capacity of the TMS 10 when a pulsing heat load is activated, but without a duty cycle cooling penalty commonly encountered with TES systems, as discussed above.

When the high heat load 49*b* is no longer in use or its temperature is reduced, this occurrence is sensed by a sensor (not shown) and a signal from the sensor (or otherwise, such as communicated directly by the high heat load 49*b*) is sent to the controller 17. The controller 17 is configured to partially or completely close the back-pressure regulator 64 by changing the set point pressure (or otherwise), partially or totally closing the exhaust line 66 to reduce or cut off exhaust refrigerant flow through the exhaust line 66. When the high heat load 49*b* reaches a desired temperature or is no longer being used, the back-pressure regulator 64 is placed in the OFF status and is thus closed, and closed-circuit portion continues to operate, as needed.

Figure 5:
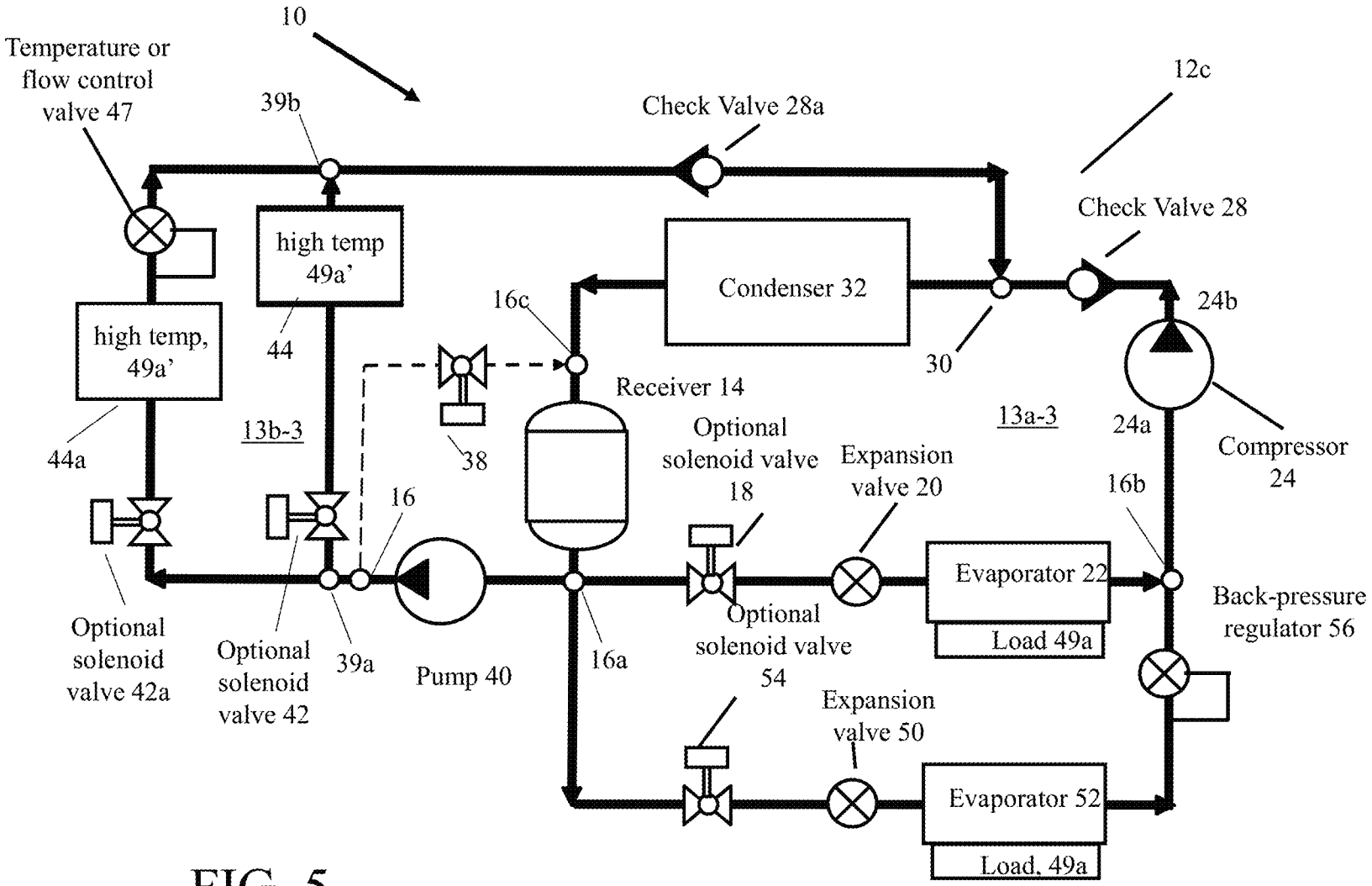
FIGS. 5 and 7 are schematic diagrams of examples of a thermal management system that includes a multi-evaporator closed-circuit refrigeration system with pump closed-circuits and vapor-compressed closed-circuits integrated with a closed-circuit refrigeration system.

Referring now to FIG. 5, a TMS 10 is shown to include another alternative M-ECCRS 12*c* that cools a high temperature load and a low temperature load (relative to the high temperature load). The M-ECCRS 12*c* includes two interacting circuits, a vapor compression closed-circuit refrigeration system 13*a*-3 and a closed-circuit pumping system 13*b*-3. The vapor compression closed-circuit refrigeration system 13*a*-3 is configured to cool heat loads at a low heat load temperature below the condensation temperature, whereas the closed-circuit pumping system 13*b*-3 cools heat loads at a high temperature that is equal to or above the condensation temperature. Examples of high temperature heat loads 49*a*' are batteries and various electronic and mechanical devices.

The vapor compression closed-circuit refrigeration system 13*a*-3 is substantially identical to the vapor compression closed-circuit refrigeration system 13*a*-1 of FIG. 1, except for the provision of a second evaporator 52 coupled in shunt with the evaporator 22, via optional solenoid control valve 54 and expansion valve 50. The vapor compression closed-circuit refrigeration system 13*a*-3 also includes a back-pressure regulator 56 coupled between the outlets of the evaporator 22 and evaporator 52, as shown. Also shown is a four-way junction device 16*a* that couples to the closed-circuit pump system 13*b*-3 and a three way junction 16*b* that couples the aforementioned outlets of the evaporators 22 and 52 to the compressor 24 inlet.

The closed-circuit pumping system 13*b*-3 is also substantially identical to the closed-circuit pumping system 13*b*-1 of FIG. 1, except for the provision of a second closed-circuit evaporator 44*a* and a second optional solenoid control valve 42*a* and a flow control valve such as a back-pressure regulator 47 coupled in shunt with the optional solenoid control valve 42 and the closed-circuit evaporator 44. Conduit couples the aforementioned devices, as shown.

Normally, the evaporators 22 and 52 of the vapor compression closed-circuit refrigeration system 13*a*-3 generate a superheat at the exit thereof. The vapor compression closed-circuit refrigeration system 13*a*-3 with liquid recirculating pump 40 (or with an ejector) can be configured to control two-phase refrigerant states exiting the evaporators 22, 52. The back-pressure regulator 56 acts as a flow control valve and maintains an inlet pressure at the inlet of the back-pressure regulator 56, so as to balance pressure flows through the evaporators 22, 52 according to a set point pressure.

The closed-circuit pumping system 13*b*-3 is similar to that discussed in FIG. 1, including the pump 40, the optional solenoid control valve 42, a heat load (such as a battery) on the closed-circuit evaporator 44, a check valve 28*a* (downstream from the pump discharge), the condenser 32 and the receiver 14. The closed-circuit pumping system 13*b*-3 also includes one (or more) additional evaporator paths. For example, the closed-circuit pumping system 13*b*-3 includes an additional closed-circuit evaporator 44*a* and optional solenoid control valve 42*a* coupled in shunt, via junctions 39*a*, 39*b* with the optional solenoid control valve 42 and closed-circuit evaporator 44. The closed-circuit pumping system 13*b*-3 may include a bypass line (a dashed line) with a control valve 38. The closed-circuit evaporators 44, 44*a* of the closed-circuit pumping system 13*b*-3 may generate a superheat at the exit or two-phase state.

As with FIG. 1, the pump 40 can be fixed or a variable speed or multi-speed pump. The system 10 may implement several methods of temperature control. For example, in one method of temperature control involves varying speed of the variable speed or multi-speed pump 40. Another example involves modulating the control valve 38 on the bypass line. Another example involves modulating a control valve (not shown) on the conduit between the junction and the receiver. Various combinations of the above examples can also be used.

An advantage of the TMS 10 is that cooling of electronics, such as batteries, is implemented without upsizing the compressor 24. Upsizing the compressor 24 to cool the battery at the same evaporating temperature as the main load or using ambient air to cool the battery would most likely require a bigger and heavier system.

A. Closed-Circuit Refrigeration Operation

When the low temperature load 49*a* is applied, the TMS 10 is configured to have the vapor compression closed-circuit refrigeration system 13*a*-3 provide refrigeration to the low temperature load 49*a*. In this instance, a controller 17 produces signals to open solenoid control valves 18 and 54 (if used). In the vapor compression closed-circuit refrigeration system 13*a*-3, circulating refrigerant enters the compressor 24 as a saturated or superheated vapor and is compressed to a higher pressure at a higher temperature (a superheated vapor). This superheated vapor is at a temperature and pressure at which it can be condensed in the condenser 32 by either cooling water or cooling air flowing across a coil or tubes in the condenser 32. At the condenser 32, the circulating refrigerant loses heat and thus removes heat from the system, which removed heat is carried away by either water or air (whichever may be the case) flowing over the coil or tubes, providing a condensed liquid refrigerant.

The condensed and sub-cooled liquid refrigerant is routed into the receiver 14, exits the receiver 14, and enters the expansion valves 20 and/or 50 (through the optional solenoid control valves 18 and 54, if used.) The refrigerant is enthalpically expanded in the expansion valves 20 and 50 and the high pressure sub-cooled liquid refrigerant turns into liquid-vapor mixture at a low pressure and temperature. The temperature of the liquid and vapor refrigerant mixture (evaporating temperature) is lower than the temperature of the low temperature load 49*a*. The mixture is routed through a coil or tubes in the evaporator 22 and evaporator 52. The back-pressure regulator 56 acts to control flow by maintaining inlet pressure at the inlet of the back-pressure regulator 56, so as to balance pressure flows through the evaporators 22, 52.

The heat from the low temperature heat load 49*a*, in contact with or proximate to, the evaporators 22 and 52, partially (provided that another mechanism is used to ensure that liquid does not enter the compressor 24 inlet) or completely evaporates the liquid portion of the two-phase refrigerant mixture, and superheats the mixture. The refrigerant leaves the evaporators 22 and 52 and enters the compressor 24. The saturated or superheated vapor exits the compressor 24, passes though the check valve 28 and enters the junction 30. The evaporators 22 and 52 are where the circulating refrigerant absorbs and removes heat from the applied low heat loads 49*a*, which heat is subsequently rejected in the condenser 32 and transferred to an ambient by water or air used in the condenser 32.

Meanwhile, the closed-circuit pumping system 13*b*-3 operates as follows: The pump 40 is turned on and causes refrigerant from the receiver 14 to be pumped by the pump 40 through the optional solenoid control valves 42 and 42*a* (also open) into junctions 39*a* and 39*b* and to the closed-circuit evaporators 44 and 44*a* that house, e.g., the high temperature heat loads 49*a*', which may be a battery and other electronics, respectively. Heat from the high temperature heat loads 49*a*' is removed into the refrigerant liquid and the refrigerant liquid carries the heat through the check valve 28*a* into the junction 30 and to the inlet of the condenser 32. The evaporators 44 and 44*a* are where the circulating refrigerant absorbs and removes heat from the high temperature heat loads 49*a*', which heat is subsequently rejected in the condenser 32, and transferred to an ambient by water or air used in the condenser 32.

Figure 6:
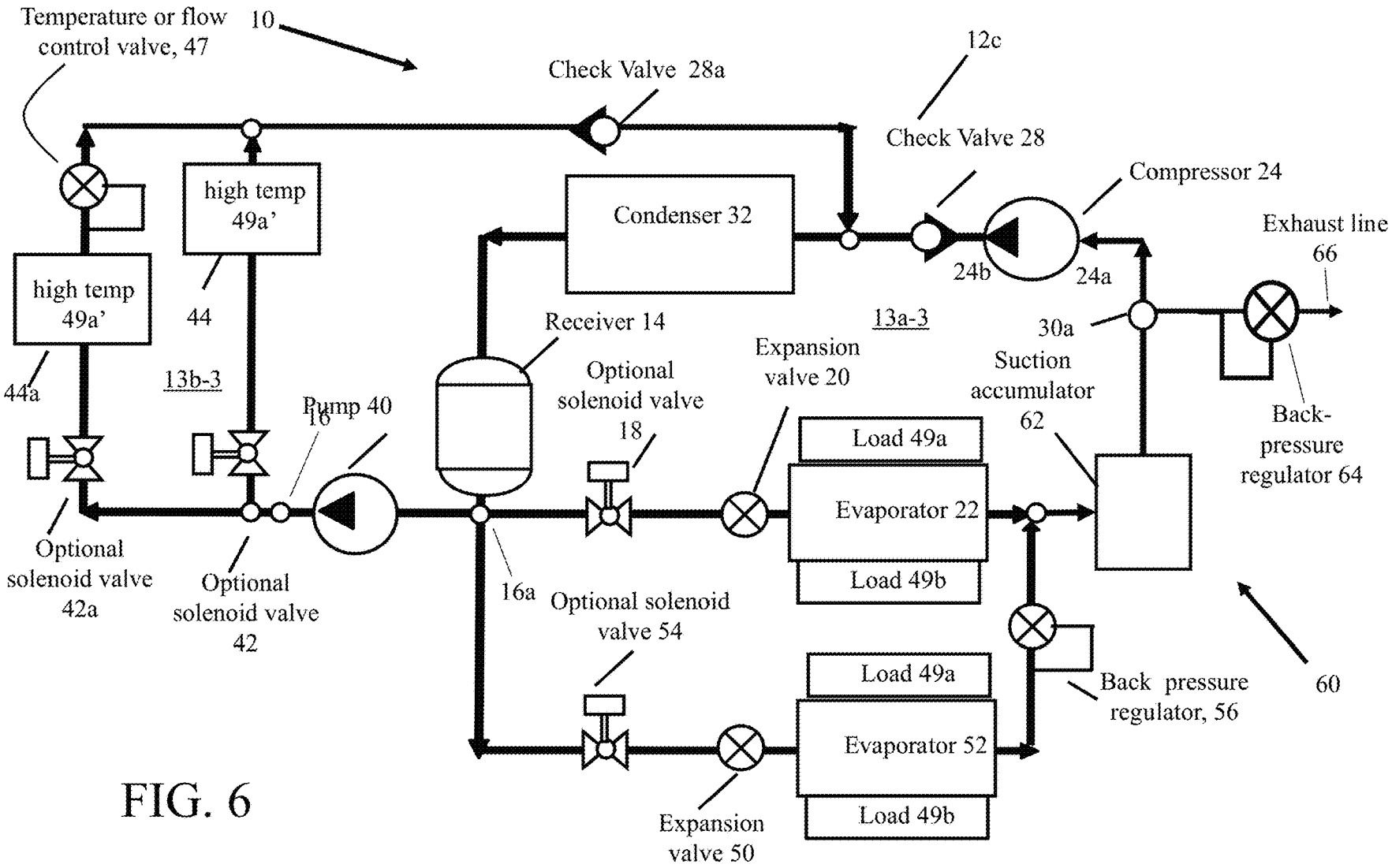
FIGS. 6 and 8 are schematic diagrams of examples of a thermal management system that includes a multi-evaporator closed-circuit refrigeration system with closed-circuits and vapor-compressed closed-circuits integrated with a closed-circuit refrigeration system.

Referring to FIG. 6, another example of the TMS 10 that includes an open-circuit refrigeration system 60 integrated with the M-ECCRS12*c* of FIG. 3, is shown. TMS 10 provides closed-circuit refrigeration for low heat loads (low temperature and high temperature) over long time intervals and open-circuit refrigeration for refrigeration of high heat loads over short time intervals (relative to the interval of refrigeration of low heat load).

The M-ECCRS 12*c* includes the vapor compression closed-circuit refrigeration system 13*a*-3 and the closed-circuit pumping system 13*b*-3, as discussed in FIG. 5. The vapor compression closed-circuit refrigeration system 13*a*-3 includes the receiver 14, the junction 16*a*, optional solenoid control valves 18 and 54, the expansion valves 20 and 50, and evaporators 22 and 52. Also included are the compressor 24, the condenser 32, the check valve 28, and the back-pressure regulator 56.

The closed-circuit pumping system 13*b*-3 is substantially identical to the closed-circuit pumping system 13*b*-3 of FIG. 5 including the second closed-circuit evaporator 44*a*, a second optional solenoid control valve 42*a* and back-pressure regulator 47 coupled in shunt with the optional solenoid control valve 42 and the closed-circuit evaporator 44. Conduit couples the aforementioned devices, as shown.

Also shown in FIG. 6 is the open-circuit refrigeration system 60. The open-circuit refrigeration system 60 includes the suction accumulator 62, the back-pressure regulator 64, and the exhaust line 66 in addition to the receiver 14, optional solenoid control valves 18 and 54, expansion valves 20 and 50, and evaporators 22 and 52.

A. Closed-Circuit Refrigeration Operation

The M-ECCRS 12*c* operates as discussed in FIG. 5, above, except that the back-pressure regulator 64 is off, and the suction accumulator 62 is interposed between the outlet of the evaporators 22 and 52 and the inlet of the compressor 24. Refrigerant from the outlets of the evaporators 22 and 52 is fed into the suction accumulator 62, and refrigerant vapor is removed from the suction accumulator 62 into the compressor inlet.

B. Open/Closed-circuit Refrigeration Operation

On the other hand, when a high heat load 49*b* is applied, a mechanism such as the controller 17 causes the M-ECCRS 12*c* to operate in both a closed and open-circuit configuration.

The closed-circuit portion is similar to that described above, except that the evaporators 22 and/or 52 in this case may operate within in a two-phase mixture of refrigerant, e.g., a threshold of a vapor quality, (e.g., the evaporators 22, 52 need not operate with a superheat provided that the suction accumulator 62 captures incidental non-evaporated liquid). The suction accumulator 62 receives the two-phase mixture, and the compressor 24 receives saturated vapor from the suction accumulator 62.

When the closed-circuit portion operates with the open cycle, this causes the controller 17 to be configured to cause the back-pressure regulator 64 to be placed in an ON position, thus opening the back-pressure regulator 64 to permit the back-pressure regulator 64 to exhaust vapor through the exhaust line 66. The back-pressure regulator 64 maintains a back-pressure at an inlet to the back-pressure regulator 64, according to a set point pressure, while allowing the back-pressure regulator 64 to exhaust refrigerant vapor through the exhaust line 66.

The open-circuit portion operates like a thermal energy storage (TES) system, increasing cooling capacity of the TMS 10 when a pulsing heat load is activated, but without a duty cycle cooling penalty commonly encountered with TES systems. The cooling duty is executed without the concomitant penalty of conventional TES systems provided that the receiver 14 has enough refrigerant charge and the refrigerant flow rate flowing through the evaporators 22 and/or 52 matches the rate needed by the high heat load 49*b*. The back-pressure regulator 64 exhausts the refrigerant vapor less the refrigerant vapor recirculated by the compressor 24. The rate of exhaust of the refrigerant vapor through the exhaust line 66 is governed by the set point pressure used at the input to the back-pressure regulator 64.

When the high heat load 49*b* is no longer in use or its temperature is reduced, this occurrence is sensed by a sensor (not shown) and a signal from the sensor (or otherwise, such as communicated directly by the high heat load 49*b*) is sent to the controller 17. The controller 17 is configured to partially or completely close the back-pressure regulator 64 by changing the set point pressure (or otherwise), partially or totally closing the exhaust line 66 to reduce or cut off exhaust refrigerant flow through the exhaust line 66. When the high heat load 49*b* reaches a desired temperature or is no longer being used, the back-pressure regulator 64 is placed in the OFF status and is thus closed, and closed-circuit portion continues to operate, as needed. The evaporators 22, 52 can have any of the configurations discussed for FIGS. 2A-2D.

Figure 7:
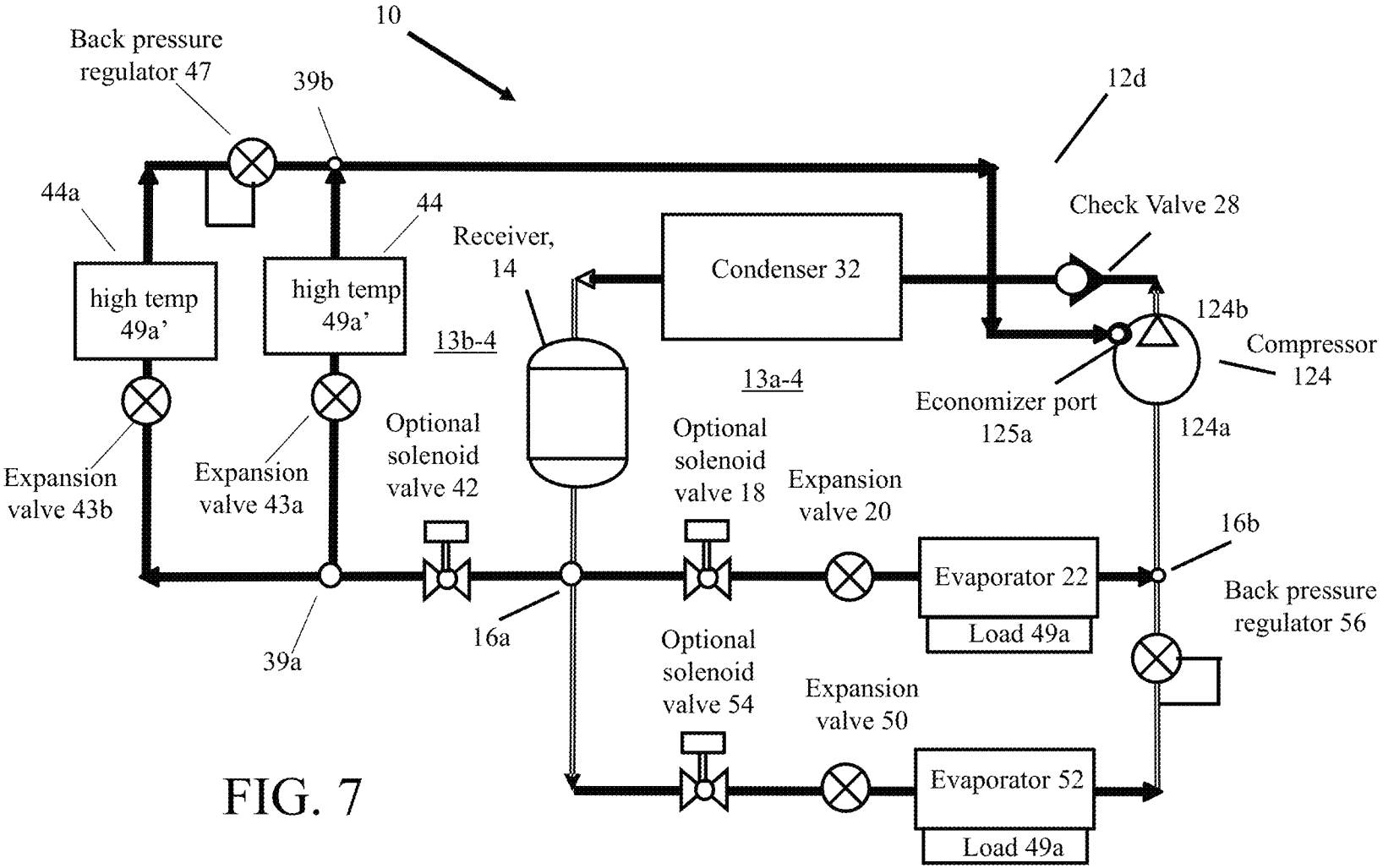

Referring now to FIG. 7, the TMS 10 is shown to include an alternative multi-evaporator closed-circuit refrigeration system 12*d* that cools a high temperature heat load 49*a*' and a low temperature heat load 49*a* (relative to the high temperature heat load 49*a*'). The M-ECCRS 12*d* includes two interacting circuits, a vapor compression closed-circuit refrigeration system 13*a*-4 and a closed-circuit system 13*b*-4. The vapor compression closed-circuit refrigeration system 13*a*-4 is configured to cool heat loads at a low heat load temperature below the condensation temperature, whereas the closed-circuit system 13*b*-4 cools heat loads at a high temperature that is equal to or above the condensation temperature. Examples of high temperature heat loads are batteries and various electronic and mechanical devices.

The vapor compression closed-circuit refrigeration system 13*a*-4 includes the features of FIG. 5, including the receiver 14, a junction device 16*a* (four-way junction). The junction device 16*a* has a first outlet coupled to the inlet of the optional solenoid control valve 18. The optional solenoid control valve 18 has an outlet coupled to the inlet of the expansion valve 20, and the expansion valve 20 has an outlet that is coupled to the inlet of the evaporator 22. The evaporator 22 has the outlet coupled to the compressor inlet 124*a* of the compressor 124 via a second junction device 16*b*. A back-pressure regulator 56 is disposed between the output of evaporator 52 and junction 16*b*. Compressor 124 is a compressor with an economizer port 125*a*. The compressor 124 has an outlet 124*b* that is coupled through the check valve 28 to the inlet of the condenser 32 and the condenser 32 has an outlet that is coupled to an inlet of the receiver 14. Conduit couples the aforementioned devices, as shown.

In addition, the vapor compression closed-circuit refrigeration system 13*a*-4 includes a second evaporator 52, with the second expansion valve 50 and the second optional solenoid control valve 54 with the inlet of the second optional solenoid control valve 54 coupled to a second outlet of the junction 16*a*. Normally, the evaporators 22 and 52 of the vapor compression closed-circuit refrigeration system 13*a*-4 generate a superheat at the exit thereof. The condenser 32 of the vapor compression closed-circuit refrigeration system 13*a*-4 can be air cooled, water cooled, or use any cooling fluid available in the vehicle or station where the system is installed.

The closed-circuit system 13*b*-4 includes the receiver 14 and the junction device 16*a* that has a second outlet coupled to an inlet of an optional solenoid valve 42. The outlet of the optional solenoid control valve 42 is coupled to junction 39*a* with an outlet of the junction 39*a* coupled to an inlet of an expansion valve 43*a* that has an outlet coupled to an inlet of the closed-circuit evaporator 44 that houses the high temperature heat load 49*a*' to be cooled. The junction 39*a* has a second outlet that is coupled to an inlet of expansion valve 43*b* that has an outlet coupled to an inlet of closed-circuit evaporator 44*a* that houses another high temperature heat load 49*a*' to be cooled. From the outlets of the closed-circuit evaporators 44 and 44*a* refrigerant fluid passes into junction 39*b* and to the economizer port 125*a* of the compressor 124. The back-pressure regulator 47 is disposed between the output of closed-circuit evaporator 44*a* and junction 39*b*. Conduit couples the aforementioned devices, as shown.

A. Closed-Circuit Refrigeration Operation

The vapor compression closed-circuit refrigeration system 13*a*-4 provides refrigeration to the low temperature heat load(s) 49*a*. In the vapor compression closed-circuit refrigeration system 13*a*-4, circulating refrigerant enters the compressor 24 as a saturated or superheated vapor and is compressed to a higher pressure at a higher temperature (a superheated vapor). This superheated vapor is at a temperature and pressure at which it can be condensed in the condenser 32 by either cooling water or cooling air flowing across a coil or tubes in the condenser 32. At the condenser 32, the circulating refrigerant loses heat and thus removes heat from the system, which removed heat is carried away by either water or air (whichever may be the case) flowing over the coil or tubes, providing a condensed liquid refrigerant.

The condensed and sub-cooled liquid refrigerant is routed into the receiver 14, exits the receiver 14, and enters the expansion valves 20 and/or 50 (through the optional solenoid control valves 18 and/or 54, if used.) The refrigerant is enthalpically expanded in the expansion valves 20, 50 and the high pressure sub-cooled liquid refrigerant turns into liquid-vapor mixtures of refrigerant at a low pressure and temperature. The temperature of the liquid and vapor refrigerant mixture (evaporating temperature) is lower than the temperature of the low heat load(s) 49*a*. The mixture is routed through a coil or tubes in the evaporators 22, 52.

The heat from the heat load(s) 49*a*, in contact with or proximate to the evaporators 22, 52, partially evaporates the liquid portion of the two-phase refrigerant mixture(s) (if a mechanism is provided to insure that no liquid passes to the compressor 124 inlet) or completely evaporates the liquid portion of the two-phase refrigerant mixture, and may generate superheated mixture(s). Refrigerant vapor leaves the evaporators 22, 52 and enters the compressor 124. The back-pressure regulator 56 enables an inlet pressure to be maintained so as to balance pressures at the evaporator outlets 22, 52.

The saturated or superheated vapor exits the compressor 124, passes though the check valve 28 and enters the condenser 32. The evaporators 22, 52 is where the circulating refrigerant absorbs and removes heat from the applied low heat load(s) 49*a*, which heat is subsequently rejected in the condenser 32 and transferred to an ambient by water or air used in the condenser 32.

Meanwhile, the closed-circuit system 13*b*-4 operates as follows: The solenoid control valve 42 (if used) is turned on causing refrigerant liquid from the receiver 14 to travel through the optional solenoid control valve 42 into the expansion valves 43*a*, 43*b* and from the expansion valves 43*s*, 43*b* into the closed-circuit evaporators 44, 44*a* that house, e.g., the battery and electronic circuitry (generally 49*a*'). Heat from the high temperature heat load 49*a*', e.g., battery and/or electronic circuitry, is removed into the circulating refrigerant and the circulating refrigerant carries the heat to the economizer port 125*a* of the compressor 124. The economizer port 125*a* allows input of vapor at an intermediate pressure that is below the discharge pressure of compressor 124 and above the suction pressure of the compressor 124. The refrigerant is discharged from the outlet 124*b* of the economizer compressor 124 through check valve 28 into the inlet of the condenser 32. The closed-circuit evaporators 44, 44*a* is where the circulating refrigerant absorbs and removes heat from the battery and/or electrical heat load(s), which heat is subsequently rejected in the condenser 32, and transferred to an ambient by water or air used in the condenser 32.

Figure 8:
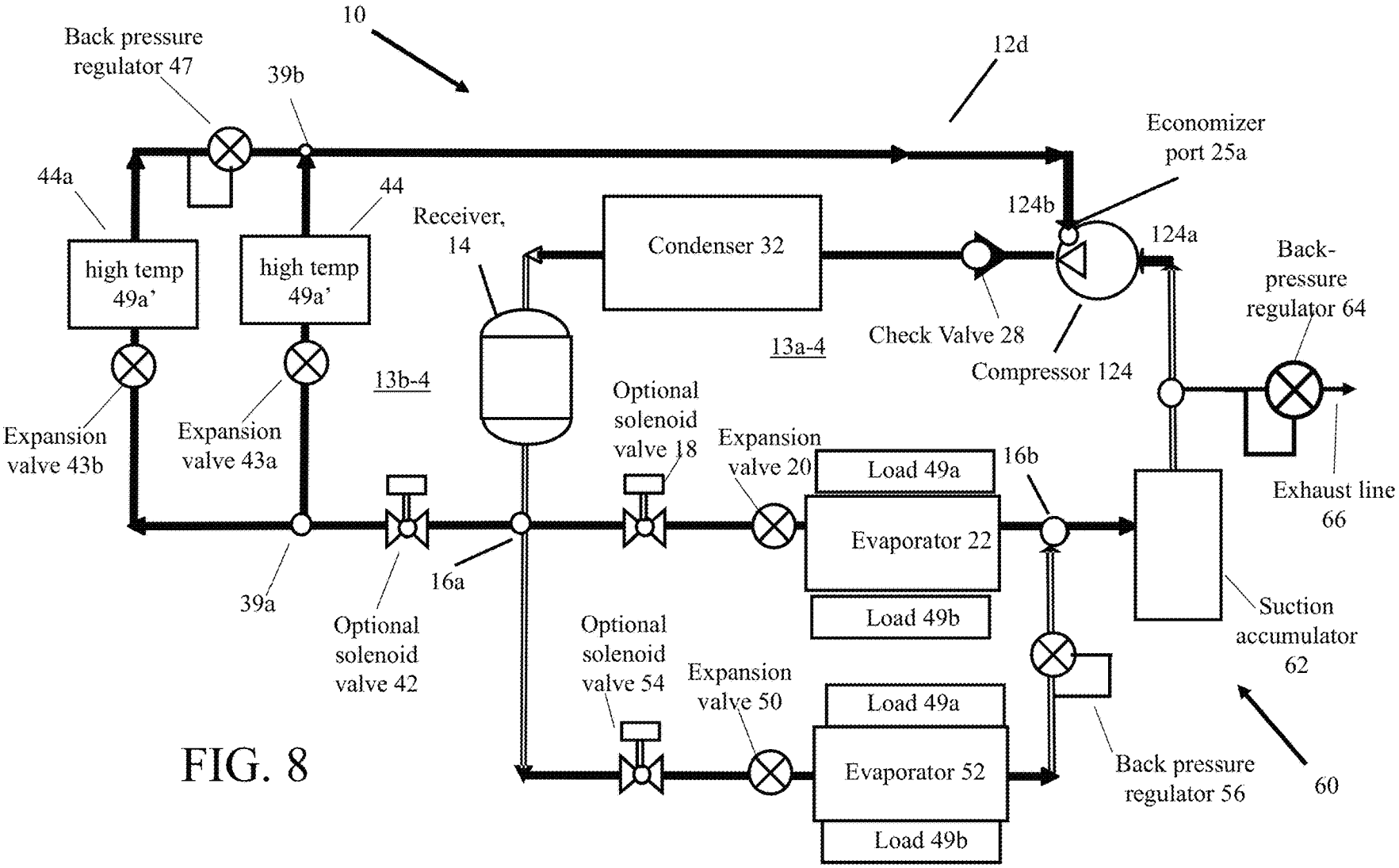

Referring to FIG. 8, another example of the TMS 10 that includes an open-circuit refrigeration system 60 integrated with the M-ECCRS 12*d* of FIG. 7, is shown. TMS 10 provides closed-circuit refrigeration for low heat loads (e.g., the low temperature heat load 49*a* or high temperature heat load 49*a*') over long time intervals and open-circuit refrigeration for refrigeration of high heat loads 49*b* over short time intervals (relative to the interval of refrigeration of low heat load 49*a*).

The M-ECCRS 12*d* includes the vapor compression closed-circuit refrigeration system 13*a*-4 and the closed-circuit pumping system 13*b*-4, as discussed in FIG. 7. The vapor compression closed-circuit refrigeration system 13*a*-4 includes the receiver 14, the junction 16*a*, optional solenoid control valves 18, 54, the expansion valves 20, 50, and the evaporators 22, 52. Also included are the compressor 124 and the condenser 32, which are coupled by the check valve 28. The outlet of the condenser 32 is coupled to the inlet of the receiver 14.

The closed-circuit pumping system 13*b*-4 includes the receiver 14, the junction device 16*a*, the optional solenoid control valve 42, and the expansion valves 43*a*, 43*b* that are coupled to the closed-circuit evaporators 44, 44*a* that house high temperature heat loads 49*a*' to be cooled. From an outlet of the closed-circuit evaporator 44*a* refrigerant fluid passes into a flow control device, such as the back-pressure regulator 47. An outlet of the back-pressure regulator 47 feeds refrigerant to a junction 39*b*. From an outlet of the closed-circuit evaporator 44 refrigerant fluid passes into the junction 39*b*. The junction 39*b* has an outlet that feeds the refrigerant to the economizer inlet 125*a* of the condenser 124. Conduit couples the aforementioned devices, as shown.

Also shown in FIG. 8 is the open-circuit refrigeration system 60. The open-circuit refrigeration system 60 includes the suction accumulator 62, the back-pressure regulator 64, and the exhaust line 66.

A. Closed-Circuit Refrigeration Operation

The M-ECCRS 12 operates as discussed in FIG. 3, above, except that the back-pressure regulator 64 is off, and the suction accumulator 62 is interposed between outlets of the evaporators 22, 52 and the inlet of the compressor 124. Refrigerant from the outlets of the evaporators 22, 52 is fed into the suction accumulator 62 through junction 16*b*, and refrigerant vapor is removed from the suction accumulator 62 into the inlet 124*a* of the compressor 124.

B. Open/Closed-circuit Refrigeration Operation

On the other hand, when a high heat load 49*b* is applied, a mechanism such as the controller 17 causes the TMS 10 to operate in the closed and/or open-circuit configuration.

The closed-circuit portion is similar to that described above, except that one or both of the evaporators 22, 52 in this case may operate within a threshold of a vapor quality, (e.g., provided that the suction accumulator 62 captures incidental non-evaporated liquid). The evaporators 22, 52 may operate at a superheat. The suction accumulator 62 receives two-phase mixture or superheated mixture, and the compressor 124 receives saturated vapor from the suction accumulator 62.

When the closed-circuit portion operates with the open cycle, this causes the controller 17 to be configured to cause the back-pressure regulator 64 to be placed in an ON position, thus opening the back-pressure regulator 64 to permit the back-pressure regulator 64 to exhaust vapor through the exhaust line 66. The back-pressure regulator 64 maintains a back-pressure at an inlet to the back-pressure regulator 64, according to a set point pressure, while allowing the back-pressure regulator 64 to exhaust refrigerant vapor through the exhaust line 66.

The open-circuit portion operates like a thermal energy storage (TES) system, increasing cooling capacity of the TMS 10 when a pulsing heat load is activated, but without a duty cycle cooling penalty commonly encountered with TES systems, as discussed above.

When the high heat load 49*b* is no longer in use or its temperature is reduced, this occurrence is sensed by a sensor (not shown) and a signal from the sensor (or otherwise, such as communicated directly by the high heat load 49*b*) is sent to the controller 17. The controller 17 is configured to partially or completely close the back-pressure regulator 64 by changing the set point pressure (or otherwise), partially or totally closing the exhaust line 66 to reduce or cut off exhaust refrigerant flow through the exhaust line 66. When the high heat load 49*b* reaches a desired temperature or is no longer being used, the back-pressure regulator 64 is placed in the OFF status and is thus closed, and closed-circuit portion continues to operate, as needed.

Figure 9:
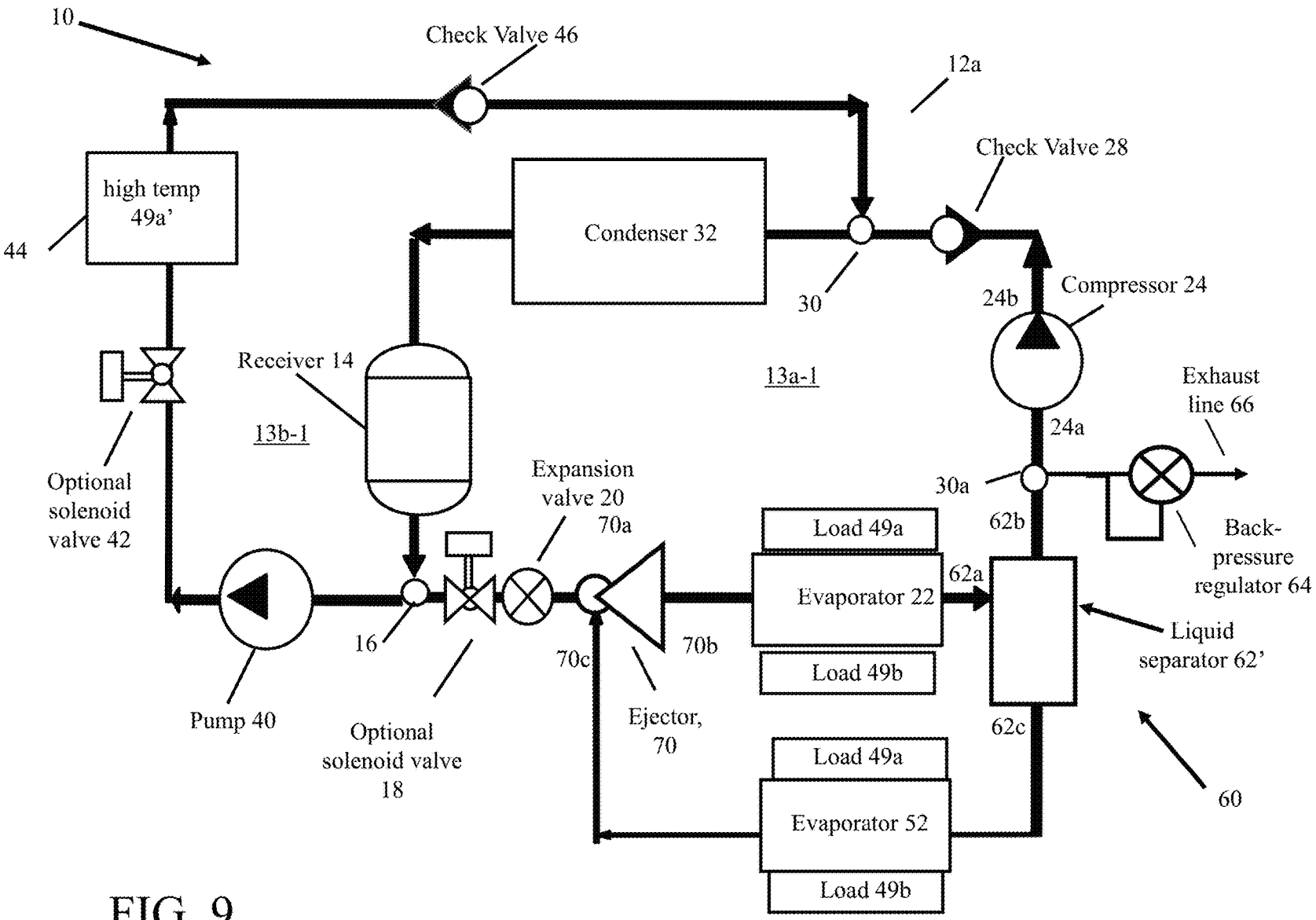
FIGS. 9 and 10 are schematic diagrams of examples of a thermal management system that includes a multi-evaporator closed-circuit refrigeration system with closed-circuits and vapor-compressed closed-circuits integrated with a closed-circuit refrigeration system and with an ejector and pump, respectively.

Referring now to FIG. 9, another example of the TMS 10 that includes an open-circuit refrigeration system 60 integrated with the M-ECCRS 12*a* of FIG. 2, is shown. TMS 10 provides closed-circuit refrigeration for low heat loads over long time intervals and open-circuit refrigeration for refrigeration of high heat loads over short time intervals (relative to the interval of refrigeration of low heat load).

The M-ECCRS portion 12*a* includes the vapor compression closed-circuit refrigeration system 13*a*-1 and the closed-circuit pumping system 13*b*-1, as discussed in FIG. 2, in addition to an ejector 70. The vapor compression closed-circuit refrigeration system 13*a*-1 includes the receiver 14, the junction 16, optional solenoid control valve 18, the expansion valve 20, the evaporators 22 and 52, a liquid separator 62', and the ejector 70. Also included are the compressor 24 and the condenser 32, which are coupled by the check valve 28. The outlet of the condenser 32 is coupled to the inlet of the receiver 14. Other embodiments could be used such as a single evaporator 22 or two evaporators 44 and 44*a* (FIG. 5).

The ejector 70 has a primary inlet 70*a* that is coupled to the expansion valve 20, an outlet 70*b* that is coupled to the optional solenoid control valve 18, and a secondary inlet 70*c* that is coupled to an outlet of the evaporator 52.

The closed-circuit pump system 13*b*-1 includes the receiver 14, the junction device 16, the pump 40, the optional solenoid control valve 42, and the closed-circuit evaporators 44 (and 44*a* FIG. 5) that house the high temperature heat load 49*a*' to be cooled. From an outlet of the closed-circuit evaporator 44 refrigerant fluid passes into the check valve 46 into the junction 30. The junction 30 outlet feeds the refrigerant to the condenser 32. Conduit couples the aforementioned devices, as shown.

Also shown in FIG. 9 is the open-circuit refrigeration system 60. The open-circuit refrigeration system 60 includes the liquid separator 62', the back-pressure regulator 64, and the exhaust line 66. In FIG. 9 (and FIG. 10 below) the liquid separator 62' has an inlet 62*a*, a vapor-side outlet 62*b* and a liquid-side outlet 62*c* that are coupled to functional components within the TMS 10.

Figure 10:
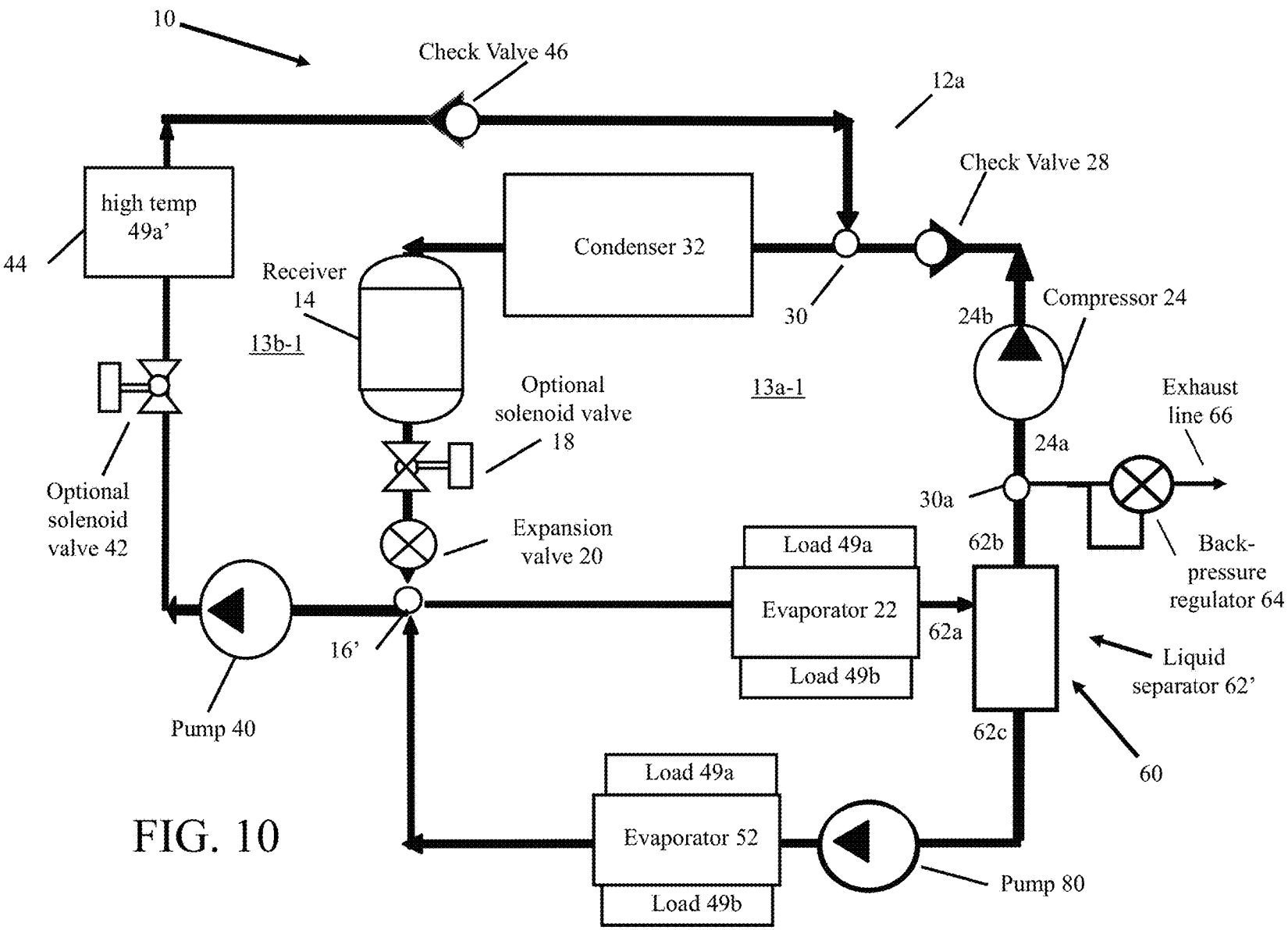

Referring now to FIG. 10, another example of the TMS 10 that includes an open-circuit refrigeration system 60 integrated with the M-ECCRS 12*a* of FIG. 2, is shown. TMS 10 provides closed-circuit refrigeration for low heat loads over long time intervals and open-circuit refrigeration for refrigeration of high heat loads over short time intervals (relative to the interval of refrigeration of low heat load).

The M-ECCRS portion 12*a* includes the vapor compression closed-circuit refrigeration system 13*a*-1 and the closed-circuit pumping system 13*b*-1, as discussed in FIG. 2 in addition to a pump 80.

The vapor compression closed-circuit refrigeration system 13*a*-1 includes the receiver 14, the four-way junction 16', optional solenoid control valve 18, the expansion valve 20, the evaporators 22 and 52, a liquid separator 62', and the pump 80. Also included are the compressor 24 and the condenser 32, which are coupled by the check valve 28 and a junction 30. The outlet of the condenser 32 is coupled to the inlet of the receiver 14. Other embodiments could be used such as a single evaporator 22 or two evaporators 44 and 44*a* (FIG. 5).

The pump 80 pumps liquid refrigerant from the liquid side outlet 62*c* of the liquid separator 62'. The pump 80 receives the liquid refrigerant at a pump inlet and pumps the liquid refrigerant from a pump outlet that is coupled to the evaporator 52 that has an outlet coupled to an inlet of the four-way junction 16'.

The closed-circuit system 13*b*-1 includes the receiver 14, the junction device 16', the pump 40, the optional solenoid control valve 42 that is coupled to the closed-circuit evaporator 44. The closed-circuit evaporator 44 houses the high temperature heat load 49*a*' to be cooled. From an outlet of the closed-circuit evaporator 44 refrigerant fluid passes into the check valve 46 into the junction 30. The junction 30 outlet feeds the refrigerant to the condenser 32. Conduit couples the aforementioned devices, as shown.

Also shown in FIG. 10 is the open-circuit refrigeration system 60. The open-circuit refrigeration system 60 includes the liquid separator 62', the back-pressure regulator 64, and the exhaust line 66 and generally functions as discussed above for FIG. 2 or FIG. 6.

Evaporator

Figure 11A:
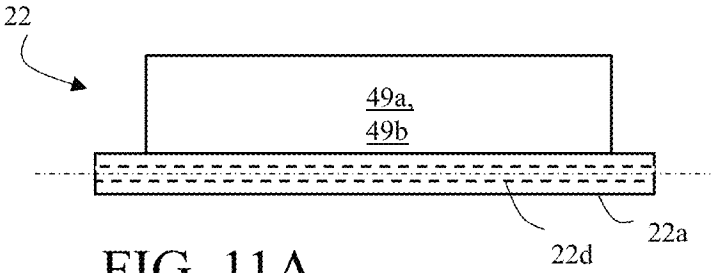
FIGS. 11A and 11B are schematic diagrams showing side and end views, respectively, of an example of the thermal load that includes refrigerant fluid channels.
Figure 11B:
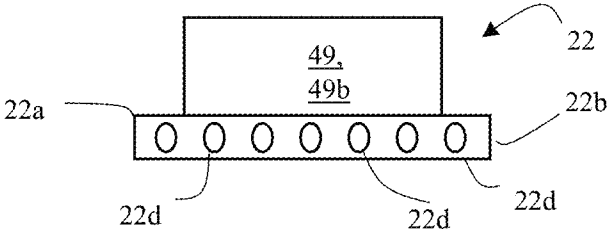

Referring to FIGS. 11A and 11B, evaporators, such as evaporator 22 can be implemented in a variety of ways. In general, evaporator 22 functions as a heat exchanger, providing thermal contact between the refrigerant fluid and heat loads 49*a*, 49*a*' (evaporator 44), and 49*b*. Typically, evaporator 22 includes one or more flow channels 22*d* extending internally between an inlet 22*a* and an outlet 22*b* of the evaporator 22, allowing refrigerant fluid to flow through the evaporator 22 and absorb heat from heat loads 49*a*, 49*a*' (evaporator 44) and/or 49*b*. Evaporators 44, 44' and 52 are similarly constructed.

A variety of different evaporators can be used in TMS 10. In general, any cold plate may function as an evaporator of the systems disclosed herein. Evaporator 22 can accommodate any refrigerant fluid channels 22*d* (including mini/micro-channel tubes), blocks of printed circuit heat exchanging structures, or more generally, any heat exchanging structures that are used to transport single-phase or two-phase fluids. The evaporator 22 and/or components thereof, such as fluid transport channels 22*d*, can be attached to the heat loads 49*a*, 49*a*' (evaporator 44), and 49*b* mechanically, or can be welded, brazed, or bonded to the heat load in any manner.

In some embodiments, evaporator 22 (or certain components thereof) can be fabricated as part of heat loads 49*a*, 49*a*' (evaporator 44), and/or 49*b* or otherwise integrated into one or more of the heat loads 49*a*, 49*a*' (evaporator 44), and/or 49*b*, as is generally shown in FIGS. 2A and 2B, in which heat load 49*b* has one or more integrated refrigerant fluid channels 22*d*. The portion of heat load 49*b* with the refrigerant fluid channels 22*d* effectively functions as the evaporator 22. The evaporator 22 can be implemented as a plurality of evaporators connected in parallel and/or in series or as individual evaporators.

Figure 12:
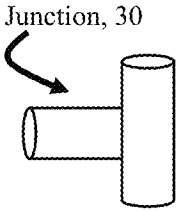
FIG. 12 is a diagram of a junction device.

FIG. 12 shows the junction device 30 (typical of all junction devices) having three ports. In some instances the junction device can have four ports, such as four-way junction 16*a* (FIG. 5).

Receiver

Figure 13:
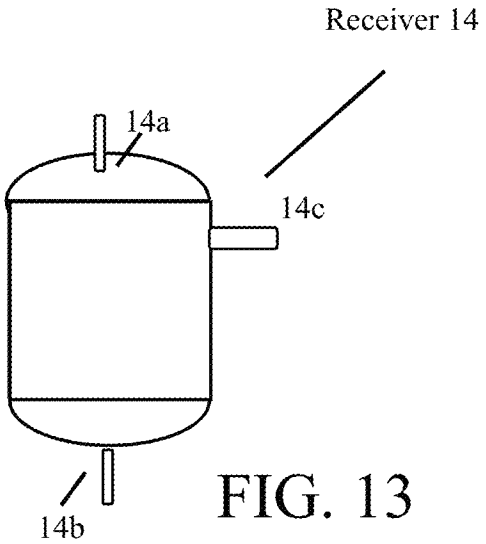
FIG. 13 is a schematic diagram of an example of a receiver for refrigerant fluid in the thermal management system.

FIG. 13 shows a schematic diagram of an example of receiver 14. Receiver 14 includes the inlet port 14*a* and the outlet port 14*b*, and may include an optional pressure relief valve 14*c*. To charge receiver 14, refrigerant fluid is typically introduced into receiver 14 via the inlet port 14*a*, and this can be done, for example, at service locations. Operating in the field, the refrigerant exits receiver 14 through outlet port 14*b* that is connected to conduit. In case of emergency, if the fluid pressure within receiver 14 exceeds a pressure limit value, pressure relief valve 14*c* opens to allow a portion of the refrigerant fluid to escape through valve 14*c* to reduce the fluid pressure within receiver 14. Receiver 14 is typically implemented as an insulated vessel that stores a refrigerant fluid at relatively high pressure. Receiver 14 can also include insulation applied around the receiver 14 to reduce thermal losses.

In general, receiver 14 can have a variety of different shapes. In some embodiments, for example, the receiver is cylindrical. Examples of other possible shapes include, but are not limited to, rectangular prismatic, cubic, and conical. In certain embodiments, receiver 14 can be oriented such that outlet port 14*b* is positioned at the bottom of the receiver. In this manner, the liquid portion of the refrigerant fluid within receiver 14 is discharged first through outlet port 14*b*, prior to discharge of refrigerant vapor. In certain embodiments, the refrigerant fluid can be an ammonia-based mixture that includes ammonia and one or more other substances. For example, mixtures can include one or more additives that facilitate ammonia absorption or ammonia burning.

Figure 14:
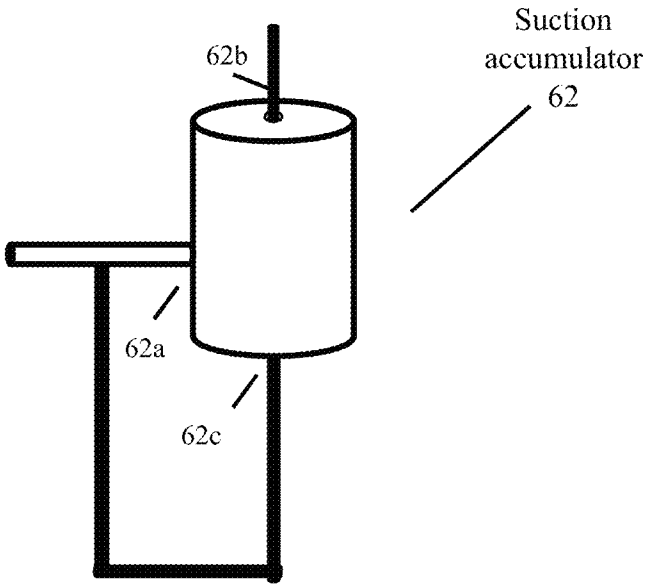
FIG. 14 is diagrammatical views of a three-port liquid separator.

Referring to FIG. 14, a configuration for the suction accumulator 62 (implemented as a coalescing liquid separator or a flash drum, for example). The suction accumulator 62, when used as such, has a vapor side port 62*b* and an inlet 62*a* coupled to conduits (not referenced) and has a liquid side outlet port 62*c* coupled to the inlet 62*a*. When used as a liquid separator 62', the liquid side outlet 62*c* is coupled to other functional devices in the system 10 instead of the inlet 62*a*. In FIGS. 1-8, the inlet 62*a* is connected to the liquid side outlet 62*c*. In FIGS. 9 and 10 the inlet 62*a*, the vapor side outlet 62*b*, and the liquid side outlet 62*c* are coupled to other functional components. Other conventional details such as membranes, coalescing filters, or meshes, etc. are not shown.

The discussion below regarding vapor quality pertains primarily to the open-circuit refrigeration system embodiments (FIGS. 2, 4, 6, and 8-10). The vapor quality of the refrigerant fluid after passing through evaporators 22 and/or 52, 44 and 44' can be controlled either directly or indirectly with respect to a vapor quality set point by the controller 17. The evaporators 22 and/or 52 may be configured to maintain exit vapor quality substantially below the critical vapor quality defined as "1."

Vapor quality is the ratio of mass of vapor to mass of liquid+vapor and is generally kept in a range of approximately 0.5 to almost 1.0; more specifically 0.6 to 0.95; more specifically 0.75 to 0.9 more specifically 0.8 to 0.9 or more specifically about 0.8 to 0.85. "Vapor quality" is thus defined as mass of vapor/total mass (vapor+liquid). In this sense, vapor quality cannot exceed "1" or be equal to a value less than "0." In practice vapor quality may be expressed as "equilibrium thermodynamic quality" that is calculated as follows:

$$X=(h-h')/(h''-h'),$$

where h is specific enthalpy, specific entropy or specific volume, h' is of saturated liquid and h" is of saturated vapor. In this case X can be mathematically below 0 or above 1, unless the calculation process is forced to operate differently. Either approach is acceptable.

During operation of the TMS 10, cooling can be initiated by a variety of different mechanisms. In some embodiments, for example, TMS 10 includes temperature sensors attached to loads 49*a*, 49*a*', and/or 49*b* (as will be discussed subsequently). When the temperature of loads 49*a*, 49*a*', and/or 49*b* exceeds a certain temperature set point (i.e., threshold value), the controller 17 connected to the temperature sensor can initiate cooling of loads 49*a*, 49*a*', and/or 49*b*. Alternatively, in certain embodiments, TMS 10 operates essentially continuously—provided that the refrigerant fluid pressure within receiver 14 is sufficient—to cool low heat load 49*a* and a temperature sensor attached to high heat loads 49*a*' and/or 49*b* will cause the controller 17 to switch in the OCRS 12*b* when the temperature of high heat loads 49*a*' and/or 49*b* exceeds a certain temperature set point (i.e., threshold value). As soon as receiver 14 is charged with refrigerant fluid, refrigerant fluid is ready to be directed into evaporator 22 to cool loads 49*a*, 49*a*', and/or 49*b*. In general, cooling is initiated when a user of the system or the heat load issues a cooling demand.

Upon initiation of a cooling operation, refrigerant fluid from receiver 14 is discharged from outlet 14*b*, through optional solenoid control valve 18, if present, and is transported through conduit to expansion valves 20 and/or 50, which directly or indirectly control vapor quality (or superheat) at the evaporator outlet. In the following discussion, expansion valves 20 and 50 are implemented as an electronic expansion valve. However, it should be understood that, more generally, expansion valves 20 and/or 50 can be implemented as any component or device that performs the functional steps described below and provides for vapor quality control (or superheat) at the evaporator outlet.

Once inside the expansion valves 20 and/or 50, the refrigerant fluid undergoes constant enthalpy expansion from an initial pressure $p_r$ (i.e., the receiver pressure) to an evaporation pressure $p_e$ at the outlet of the expansion valves 20 and/or 50. In general, the evaporation pressure $p_e$ depends on a variety of factors, e.g., the desired temperature set point value (i.e., the target temperature) at which loads 49*a*, 49*a*', and/or 49*b* are to be maintained and the heat input generated by the respective heat loads. Set points will be discussed below.

The initial pressure in the receiver 14 tends to be in equilibrium with the surrounding temperature and is different for different refrigerants. (Operational conditions of the compressor 24 and condenser 32 may be configured to maintain a higher condensing pressure.) The pressure in the evaporators 22 and/or 52 depends on the evaporating temperature, which is lower than the heat load temperature and is defined during design of the TMS 10. The TMS 10 is operational as long as the receiver-to-evaporator pressure difference is sufficient to drive adequate refrigerant fluid flow through the expansion valves 20 and/or 50. After undergoing constant enthalpy expansion in the expansion valves 20 and/or 50, the liquid refrigerant fluid is converted to a mixture of liquid and vapor phases at the temperature of the fluid and evaporation pressure pc. The two-phase refrigerant fluid mixture is transported via conduit to evaporators 22 and/or 52.

Most of the discussion below pertains to cooling of the high heat loads 49*a*' and/or 49*b*. When the two-phase mixture of refrigerant fluid is directed into evaporators 22 and/or 52 (generally, evaporator 22), the liquid phase absorbs heat from loads 49*a*, 49*a*', and/or 49*b*, driving a phase transition of the liquid refrigerant fluid into the vapor phase. Because this phase transition occurs at (nominally) constant temperature, the temperature of the refrigerant fluid mixture within evaporator 22 remains unchanged, provided at least some liquid refrigerant fluid remains in evaporator 22 to absorb heat.

Further, the constant temperature of the refrigerant fluid mixture within evaporator 22 can be controlled by adjusting the pressure $p_e$ of the refrigerant fluid, since adjustment of $p_e$ changes the boiling temperature of the refrigerant fluid. Thus, by regulating the refrigerant fluid pressure pc upstream from evaporator 22, the temperature of the refrigerant fluid within evaporator 22 (and, nominally, the temperature of heat load 49*b*) can be controlled to match a specific temperature set-point value for heat load 49*b*, ensuring that loads 49*a*, 49*a*', and 49*b* are maintained at, or very near, a target temperature.

The pressure drop across the evaporator 22 causes drop of the temperature of the refrigerant mixture (which is the evaporating temperature), but still the evaporator 22 can be configured to maintain the heat load temperature within the set tolerances.

In some embodiments, for example, the evaporation pressure of the refrigerant fluid can be adjusted by pressure of the back-pressure regulators 64 and 47 to ensure that the temperatures of thermal loads 49*a*, 49*a*', and 49*b* are maintained to within ±5 degrees C. (e.g., to within ±4 degrees C., to within ±3 degrees C., to within ±2 degrees C., to within ±1 degree C.) of the temperature set point value for loads 49*a*, 49*a*', and 49*b*.

As discussed above, within evaporator 22, a portion of the liquid refrigerant in the two-phase refrigerant fluid mixture is converted to refrigerant vapor by undergoing a phase change. As a result, the refrigerant fluid mixture that emerges from evaporator 22 has a higher vapor quality (i.e., the fraction of the vapor phase that exists in refrigerant fluid mixture) than the refrigerant fluid mixture that enters evaporator 22.

As the refrigerant fluid mixture emerges from evaporator 22, a portion of the refrigerant fluid can optionally be used to cool one or more additional thermal loads. Typically, for example, the refrigerant fluid that emerges from evaporator 22 is nearly in the vapor phase. The refrigerant fluid vapor (or, more precisely, high vapor quality fluid vapor) can be directed into a heat exchanger coupled to another thermal load, and can absorb heat from the additional thermal load during propagation through the heat exchanger.

For open-circuit operation, the refrigerant fluid emerging from evaporator 22 is transported through conduit to the liquid separator 22 and vapor emerges at the vapor side outlet of the liquid separator 22. This vapor is partially expelled from the TMS 10 via operation of the back-pressure regulator 64.

Refrigerant fluid discharge can occur directly into the environment surrounding the TMS 10. Alternatively, in some embodiments, the refrigerant fluid can be further processed; various features and aspects of such processing are discussed in further detail below.

It should be noted that the foregoing steps, while discussed sequentially for purposes of clarity, occur simultaneously and continuously during cooling operations. In other words. refrigerant fluid is continuously being discharged from receiver 14, undergoing continuous expansion in expansion valves 20 and/or 50, flowing continuously through evaporators 22, 44/44' and/or 52, and being discharged from the TMS 10, while thermal loads 49*a*, 49*a*', and/or 49*b* are being cooled.

During operation of the TMS 10, as refrigerant fluid is drawn from receiver 14 and used to cool high heat load 49*b*, the receiver pressure $p_r$ falls. If the refrigerant fluid pressure $p_r$ in receiver 14 is reduced to a value that is too low, the pressure differential $p_r$-$p_e$ may not be adequate to drive sufficient refrigerant fluid mass flow to provide adequate cooling of the high heat load 49*b*. Accordingly, when the refrigerant fluid pressure $p_r$ in receiver 14 is reduced to a value that is sufficiently low, the capacity of TMS 10 to maintain a particular temperature set point value for loads 49*a*-49*b* may be compromised. Therefore, the pressure in the receiver 14 or pressure drop across the expansion valve 20 (or any related refrigerant fluid pressure or pressure drop in TMS 10) can be an indicator of the remaining operational time. An appropriate warning signal can be issued (e.g., by the controller 17) to indicate that, in a certain period of time, the system may no longer be able to maintain adequate cooling performance; operation of the system can even be halted if the refrigerant fluid pressure in receiver 14 reaches the low-end threshold value.

It should be noted that TMS 10 can include single or multiple refrigerant receivers to allow for operation of the system over an extended time period.

B. System Operational Control

As discussed in the previous section, by adjusting the pressure pc of the refrigerant fluid, the temperature at which the liquid refrigerant phase undergoes vaporization within evaporators 22 and/or 52 (generally, evaporator 22) can be controlled. Thus, in general, the temperature of heat loads 49*a*, 49*a*', and 49*b* can be controlled by a device or component of TMS 10 that regulates the pressure of the refrigerant fluid within evaporator 22. System operating parameters include the superheat and the vapor quality of the refrigerant fluid emerging from evaporator 22.

The vapor quality, which is a number from 0 to 1, represents the fraction of the refrigerant fluid that is in the vapor phase. Considering the high heat load 49*b* individually, because heat absorbed from heat load 49*b* is used to drive a constant-temperature evaporation of liquid refrigerant to form refrigerant vapor in evaporator 22, it is generally important to ensure that, for a particular volume of refrigerant fluid propagating through evaporator 22, at least some of the refrigerant fluid remains in liquid form right up to the point at which the exit aperture of evaporator 22 is reached to allow continued heat absorption from heat load 49*b* without causing a temperature increase of the refrigerant fluid. If the fluid is fully converted to the vapor phase after propagating only partially through evaporator 22, further heat absorption by the (now vapor-phase) refrigerant fluid within evaporator 22 will lead to a temperature increase of the refrigerant fluid and heat load 49*b*.

On the other hand, liquid-phase refrigerant fluid that emerges from evaporator 22 represents unused heat-absorbing capacity, in that the liquid refrigerant fluid did not absorb sufficient heat from the high heat load 49*b* to undergo a phase change. To ensure that TMS 10 operates efficiently, the amount of unused heat-absorbing capacity should remain relatively small.

In addition, the boiling heat transfer coefficient that characterizes the effectiveness of heat transfer from the high heat load 49*b* to the refrigerant fluid is typically very sensitive to vapor quality. When the vapor quality increases from zero to a certain value, called a critical vapor quality, the heat transfer coefficient increases. When the vapor quality exceeds the critical vapor quality, the heat transfer coefficient is abruptly reduced to a very low value, causing dry out within evaporator 22. In this region of operation, the two-phase mixture behaves as superheated vapor.

In general, the critical vapor quality and heat transfer coefficient values vary widely for different refrigerant fluids, and heat and mass fluxes. For all such refrigerant fluids and operating conditions, the systems and methods disclosed herein control the vapor quality at the outlet of the evaporator such that the vapor quality approaches the threshold of the critical vapor quality.

To make maximum use of the heat-absorbing capacity of the two-phase refrigerant fluid mixture for high heat load 49*b*, the vapor quality of the refrigerant fluid emerging from evaporator 22 should nominally be equal to the critical vapor quality. Accordingly, to both efficiently use the heat-absorbing capacity of the two-phase refrigerant fluid mixture and also ensure that the temperature of heat load 49*b* remains approximately constant at the phase transition temperature of the refrigerant fluid in evaporator 22, the systems and methods disclosed herein are generally configured to adjust the vapor quality of the refrigerant fluid emerging from evaporator 22 to a value that is less than or equal to the critical vapor quality.

Another important operating consideration for TMS 10 is the mass flow rate of refrigerant fluid within TMS 10. Evaporator can be configured to provide minimal mass flow rate controlling maximal vapor quality, which is the critical vapor quality. By minimizing the mass flow rate of the refrigerant fluid according to the cooling requirements for high heat load 49, TMS 10 operates efficiently. Each reduction in the mass flow rate of the refrigerant fluid (while maintaining the same temperature set point value for heat load 49) means that the charge of refrigerant fluid added to receiver 14 initially lasts longer, providing further operating time for TMS 10.

Within evaporator 22, the vapor quality of a given quantity of refrigerant fluid varies from the evaporator inlet 22*a* (where vapor quality is lowest) to the evaporator outlet 22*b* (where vapor quality is highest). Nonetheless, to realize the lowest possible mass flow rate of the refrigerant fluid within the system, the effective vapor quality of the refrigerant fluid within evaporator 22—even when accounting for variations that occur within evaporator 22—should match the critical vapor quality as closely as possible.

M-ECCRS power demand and M-ECCRS efficiency are optimal when the evaporating temperature is as high as possible and the condensing pressure is as low as possible. The condenser 32 and evaporator 22 dimensions can be reduced when the evaporating temperature is as low as possible and the condensing pressure is as high as possible.

To ensure that the OCRS 60 operates efficiently and the mass flow rate of the refrigerant fluid is relatively low, and at the same time the temperature of the high heat load 49*b* is maintained within a relatively small tolerance, TMS 10 adjusts the vapor quality of the refrigerant fluid emerging from evaporator 22 to a value such that an effective vapor quality within evaporator 22 matches, or nearly matches, the critical vapor quality. At the same time requirements for CCRS efficient operation would be taken into consideration as well. In addition, generally compressors 24 and 124 do not work well with liquids at their inlets and it is not desirable for excess accumulation of refrigerant liquid in the suction accumulator 60. Accordingly, operation of FIGS. 2, 4, 6, and 8-10 as close as possible to the critical vapor quality is desirable.

In TMS 10, expansion valves 20 and/or 50 are generally configured to control the vapor quality of the refrigerant fluid emerging from evaporator 22. As an example, when expansion valve 20 is implemented as an expansion valve device, the expansion valve regulates the mass flow rate of the refrigerant fluid through the valve. In turn, for a given set of operating conditions (e.g., ambient temperature), initial pressure in the receiver, temperature set point value for heat load 49*b*, the vapor quality determines mass flow rate of the refrigerant fluid emerging from evaporator 22.

Expansion valve 20 typically controls the vapor quality of the refrigerant fluid emerging from evaporator 22 in response to information about at least one thermodynamic quantity that is either directly or indirectly related to the vapor quality.

In general, a wide variety of different measurement and control strategies can be implemented in TMS 10 to achieve the control objectives discussed above. These strategies are presented below. Generally, expansion valve 20 is connected to a measurement device or sensor (not shown). The measurement device provides information about the thermodynamic quantities upon which adjustments of the various control devices are based.

Refrigerants and Considerations for Choosing Configurations

A variety of different refrigerant fluids can be used in TMS 10. Depending on the application for both open-circuit refrigeration system operation and closed-circuit refrigeration system operation, emissions regulations and operating environments may limit the types of refrigerant fluids that can be used.

For example, in certain embodiments, the refrigerant fluid can be ammonia having very large latent heat; after passing through the cooling circuit, the ammonia refrigerant vapor in the open-circuit operation can be disposed of by incineration, by chemical treatment (i.e., neutralization), and/or by direct venting to the atmosphere. In certain embodiments, the refrigerant fluid can be an ammonia-based mixture that includes ammonia and one or more other substances. For example, mixtures can include one or more additives that facilitate ammonia absorption or ammonia burning.

More generally, any fluid can be used as a refrigerant in the open-circuit refrigeration systems disclosed herein, provided that the fluid is suitable for cooling heat loads 49*a*-49*b* (e.g., the fluid boils at an appropriate temperature) and, in embodiments where the refrigerant fluid is exhausted directly to the environment, regulations and other safety and operating considerations do not inhibit such discharge.

Ammonia under standard conditions of pressure and temperature is in a liquid or two-phase state. Thus, the receiver 14 typically will store ammonia at a saturated pressure corresponding to the surrounding temperature. The pressure in the receiver 14 storing ammonia will change during operation. The use of the expansion valve 20 can stabilize pressure in the receiver 14 during operation, by adjusting the expansion valve 20 (e.g., automatically or by controller 17) based on a measurement of the evaporation pressure ($p_e$) of the refrigerant fluid and/or a measurement of the evaporation temperature of the refrigerant fluid.

Controller 17 can adjust expansion valve 20 based on measurements of one or more of the following system parameter values: the pressure drop ($p_r$-$p_e$) across expansion valve 20, the pressure drop across evaporator 22, the refrigerant fluid pressure in receiver 14 ($p_r$), the vapor quality of the refrigerant fluid emerging from evaporator 22 (or at another location in the system), the superheat value of the refrigerant fluid in the system, the evaporation pressure ($p_e$) of the refrigerant fluid, and the evaporation temperature of the refrigerant fluid.

To adjust expansion valve 20 based on a particular value of a measured system parameter value, controller 17 compares the measured value to a set point value (or threshold value) for the system parameter, as will be discussed below.

A variety of different refrigerant fluids can be used in any of the configurations. For open-circuit refrigeration systems, in general, emissions regulations and operating environments may limit the types of refrigerant fluids that can be used. For example, in certain embodiments, the refrigerant fluid can be ammonia having very large latent heat; after passing through the cooling circuit, vaporized ammonia that is captured at the vapor port of the liquid separator can be disposed of by incineration, by chemical treatment (i.e., neutralization), and/or by direct venting to the atmosphere.

Since liquid refrigerant temperature is sensitive to ambient temperature, the density of liquid refrigerant changes even though the pressure in the receiver 14 remains the same. Also, the liquid refrigerant temperature impacts the vapor quality at the evaporator inlet.

FIG. 14 above depicted a configuration for the liquid separator (implemented as a coalescing liquid separator or a flash drum) and used as a suction accumulator 62 having ports 62*a*-62*c* coupled to conduit.

Figures 15A, 15B, 15C:
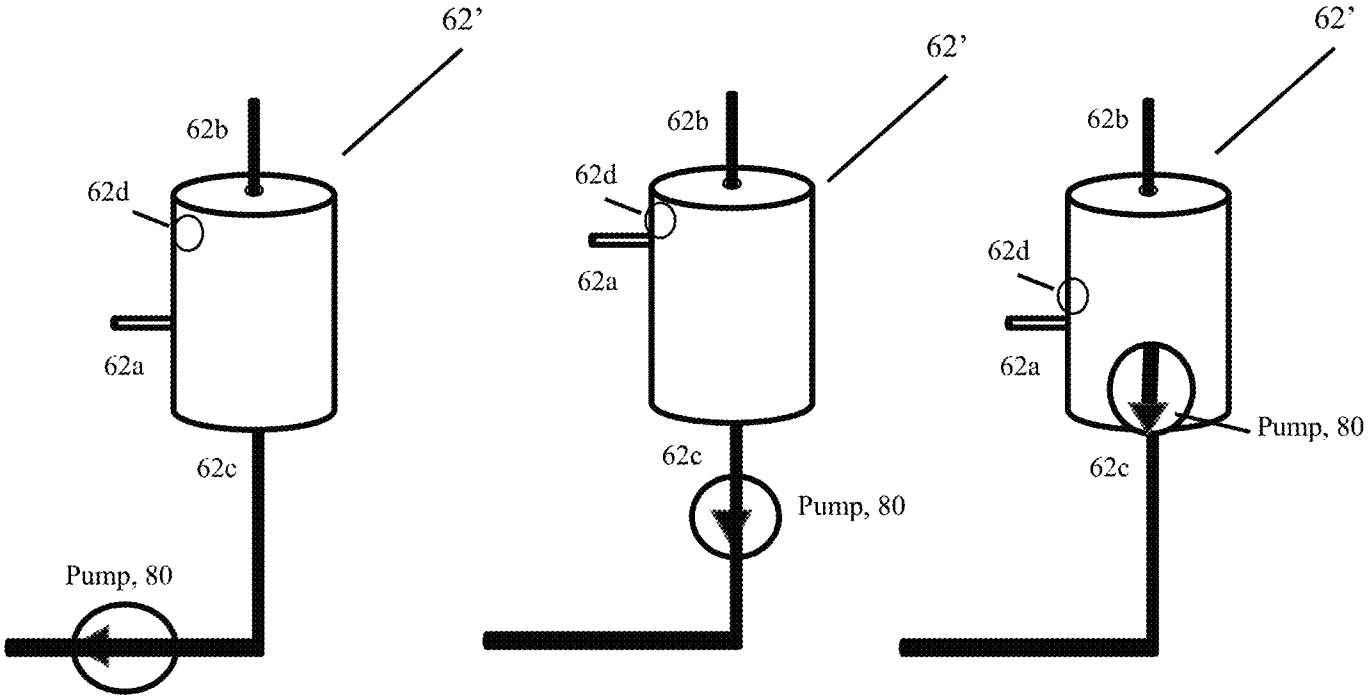
FIGS. 15A-15C are schematic diagrams of other examples of a liquid separator.

FIGS. 15A-15C, depict alternative configurations of the liquid separator 62' (implemented as a flash drum, for example), which has ports 62*a*-62*c*, especially useful for the open-circuit refrigeration system configurations that include pump 80 (such as FIG. 10).

In FIG. 15A, the pump 80 (shown in FIG. 10) is located distal from the liquid side port 62*c*. This configuration potentially presents the possibility of cavitation. To minimize the possibility of cavitation one of the configurations of FIG. 15B or FIG. 15C can be used.

In FIG. 15B, the pump 80 is located distal from the liquid side outlet 62*c*, but the height at which the inlet 62*a* is located is higher than that of FIG. 15A. This would result in an increase in liquid pressure at the liquid side outlet 62*c* of the liquid separator 62' and concomitant therewith an increase in liquid pressure at the inlet of the pump 80. Increasing the pressure at the inlet to the pump 80 should minimize possibility of cavitation.

Another strategy is presented in FIG. 15C, where the pump 80 is located proximate to or indeed, as shown, inside of the liquid side outlet 62*c*. In addition, although not shown, the height at which the inlet is located can be adjusted to that of FIG. 15B, rather than the height of as shown in FIG. 15C. This would result in an increase in liquid pressure at the inlet of the pump 80 further minimizing the possibility of cavitation.

Another alternative strategy that can be used involves the use of a sensor 62*d* that produces a signal that is a measure of the height of a column of liquid in the liquid separator 62'. The signal is sent to the controller 17 that will be used to start the pump 80, once a sufficient height of liquid is contained by the liquid separator 62'.

IV. Additional Features of Thermal Management Systems

The foregoing examples of TMS illustrate a number of features that is included in any of the systems within the scope of this description. In addition, a variety of other features is present in such systems.

In certain embodiments (e.g., FIGS. 2, 4, 6, and 8-10), refrigerant fluid that is discharged from evaporators 22, 52, 44, and/or 44' and passes through conduit and back-pressure regulators 64 and/or 47 is directly discharged as exhaust from conduit without further treatment. Direct discharge provides a convenient and straightforward method for handling spent refrigerant, and has the added advantage that over time, the overall weight of the system is reduced due to the loss of refrigerant fluid. For systems that are mounted to small vehicles or are otherwise mobile, this reduction in weight is important.

In some embodiments, however, refrigerant fluid vapor is further processed before it is discharged. Further processing may be desirable depending upon the nature of the refrigerant fluid that is used, as direct discharge of unprocessed refrigerant fluid vapor may be hazardous to humans and/or may deleterious to mechanical and/or electronic devices in the vicinity of the system. For example, the unprocessed refrigerant fluid vapor may be flammable or toxic, or may corrode metallic device components. In situations such as these, additional processing of the refrigerant fluid vapor may be desirable.

In general, refrigerant processing apparatus can be implemented in various ways. In some embodiments, refrigerant processing apparatus is a chemical scrubber or water-based scrubber. Within apparatus, the refrigerant fluid is exposed to one or more chemical agents that treat the refrigerant fluid vapor to reduce its deleterious properties. For example, where the refrigerant fluid vapor is basic (e.g., ammonia) or acidic, the refrigerant fluid vapor can be exposed to one or more chemical agents that neutralize the vapor and yield a less basic or acidic product that can be collected for disposal or discharged from apparatus.

Another example has the refrigerant vapor exposed to one or more chemical agents that oxidize, reduce, or otherwise react with the refrigerant fluid vapor to yield a less reactive product that is collected for disposal or discharged from apparatus. Other examples are possible.

In certain embodiments, refrigerant vapor processing apparatus is implemented as an adsorptive sink for the refrigerant fluid. Apparatus can include, for example, an adsorbent material bed that binds particles of the refrigerant fluid vapor, trapping the refrigerant fluid within apparatus and preventing discharge. The adsorptive process can sequester the refrigerant fluid particles within the adsorbent material bed, which can then be removed from apparatus and sent for disposal. In some embodiments, where the refrigerant fluid is flammable, refrigerant vapor processing apparatus is implemented as an incinerator. Incoming refrigerant fluid vapor is mixed with oxygen or another oxidizing agent and ignited to combust the refrigerant fluid. The combustion products are discharged from the incinerator or collected (e.g., via an adsorbent material bed) for later disposal.

As an alternative, refrigerant vapor processing apparatus can also be implemented as a combustor of an engine or another mechanical power-generating device. Refrigerant fluid vapor from is mixed with oxygen, for example, and combusted in a piston-based engine or turbine to perform mechanical work, such as providing drive power for a vehicle or driving a generator to produce electricity. In certain embodiments, the generated electricity is used to provide electrical operating power for one or more devices, including thermal load 49*b*.

V. Integration with Power Systems

In some embodiments, the refrigeration systems disclosed herein can combined with power systems to form integrated power and thermal systems, in which certain components of the integrated systems are responsible for providing refrigeration functions and certain components of the integrated systems are responsible for generating operating power.

Figure 16:
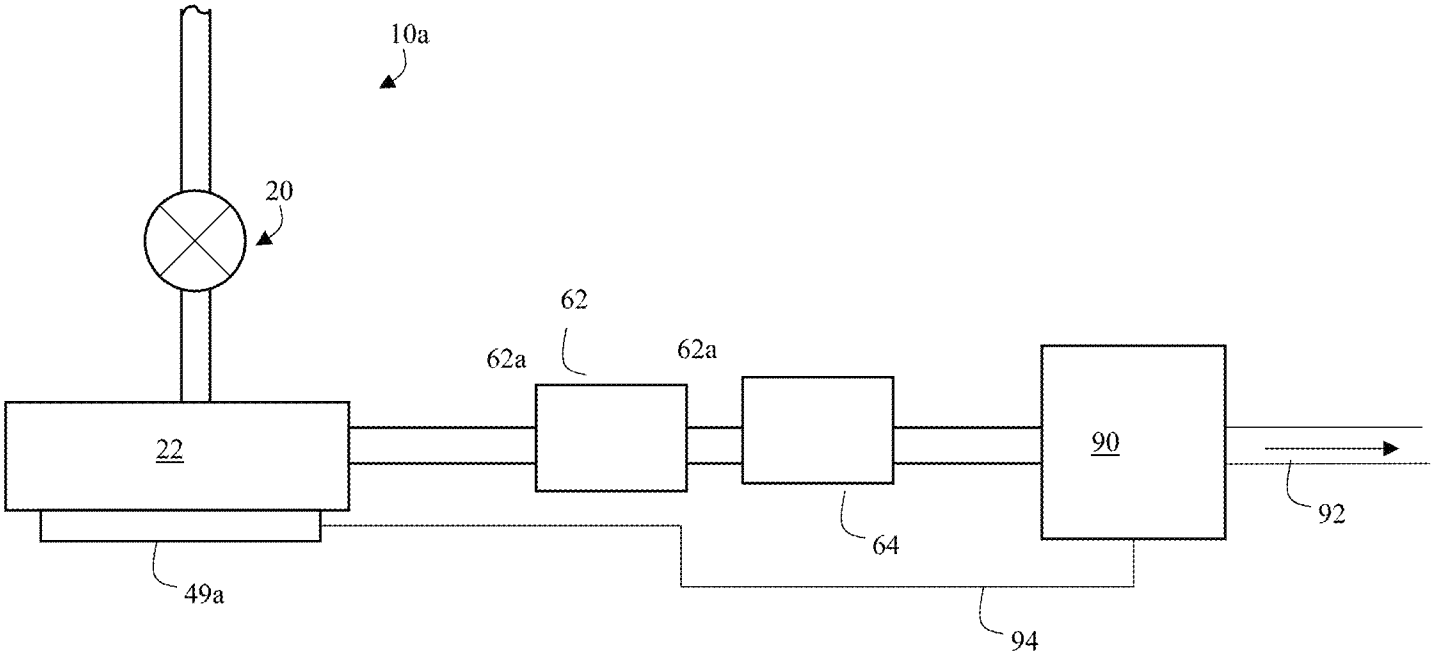
FIG. 16 is a schematic diagram of an example of a thermal management system that includes a power generation apparatus.

FIG. 16 shows an integrated power and TMS 10*a* that includes many features similar to those discussed above. The TMS 10*a* includes the M-ECCRS 12 and back-pressure regulator 64. In addition, TMS 10*a* includes an engine 90 with an inlet that receives the stream of waste refrigerant fluid that enters conduit after passing through back-pressure regulator 64. Engine 90 can combust the waste refrigerant fluid directly, or alternatively, can mix the waste refrigerant fluid with one or more additives (such as oxidizers) before combustion. Where ammonia is used as the refrigerant fluid, suitable engine configurations for both direct ammonia combustion as fuel, and combustion of ammonia mixed with other additives, can be implemented. In general, combustion of ammonia improves the efficiency of power generation by the engine.

The energy released from combustion of the refrigerant fluid can be used by engine 90 to generate electrical power, e.g., by using the energy to drive a generator. The electrical power is delivered via electrical connection 94, e.g., to thermal load 49*a* to provide operating power for the load 49*a*. For example, in certain embodiments, thermal load 49*a* includes one or more electrical circuits and/or electronic devices, and engine 90 provides operating power to the circuits/devices via combustion of refrigerant fluid. Byproducts of the combustion process is discharged from engine 90 via exhaust conduit 92, as shown in FIG. 16.

Various types of engines and power-generating devices are implemented as engine 90 in TMS 10*a*. In some embodiments, for example, engine 90 is a conventional four-cycle piston-based engine, and the waste refrigerant fluid is introduced into a combustor of the engine. In certain embodiments, engine 90 is a gas turbine engine, and the waste refrigerant fluid is introduced via the engine inlet to the afterburner of the gas turbine engine.

VII. Integration with Directed Energy Systems

The TMS and methods disclosed herein can implemented as part of (or in conjunction with) directed energy systems such as high energy laser systems. Due to their nature, directed energy systems typically present a number of cooling challenges, including certain heat loads for which temperatures are maintained during operation within a relatively narrow range.

Figure 17:
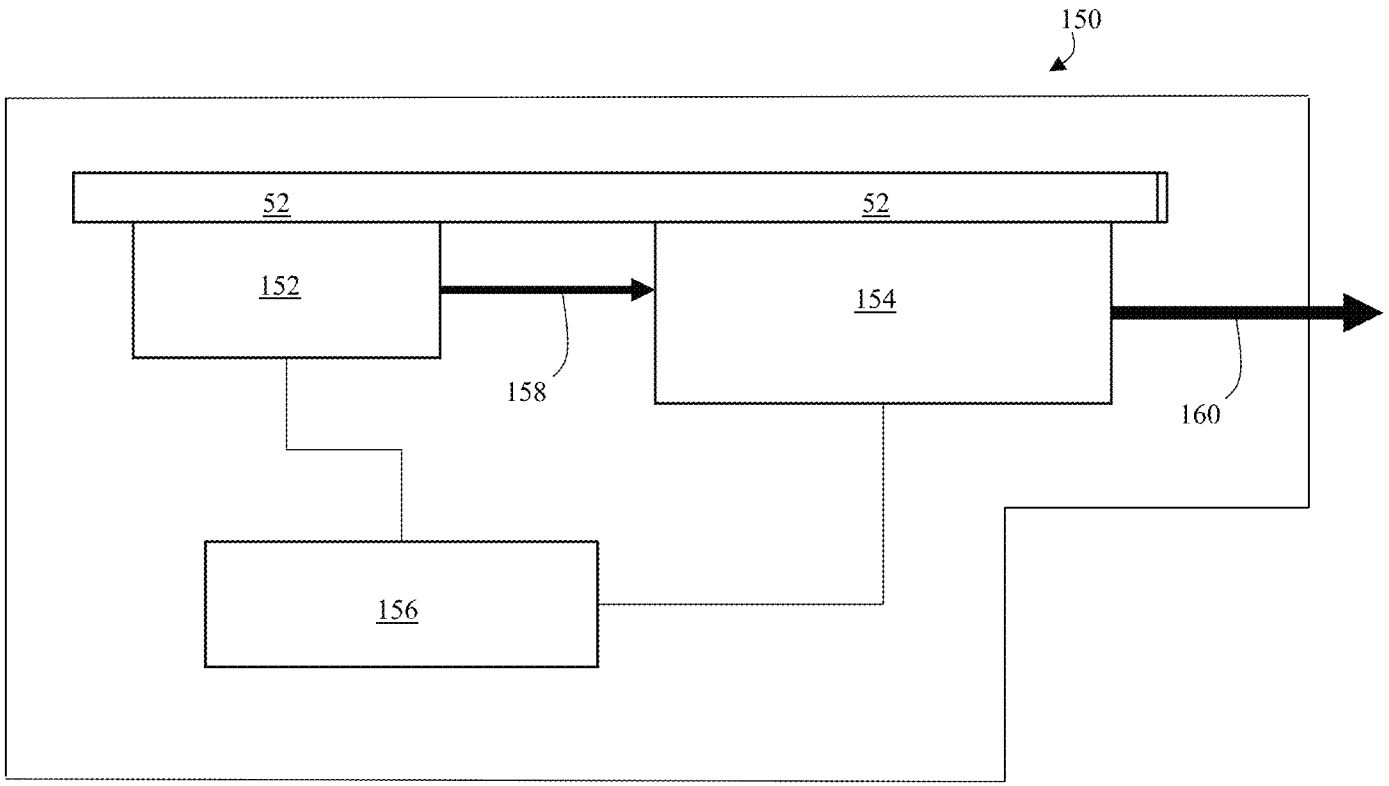
FIG. 17 is a schematic diagram of an example of directed energy system that includes a thermal management system.

FIG. 17 shows one example of a directed energy system, specifically, a high energy laser system 150. System 150 includes a bank of one or more laser diodes 152 and an amplifier 154 connected to a power source 156. During operation, laser diodes 152 generate an output radiation beam 158 that is amplified by amplifier 154, and directed as output beam 160 onto a target. Generation of high energy output beams can result in the production of significant quantities of heat. Certain laser diodes, however, are relatively temperature sensitive, and the operating temperature of such diodes is regulated within a relatively narrow range of temperatures to ensure efficient operation and avoid thermal damage. Amplifiers are also temperature-sensitively, although typically less sensitive than diodes.

To regulate the temperatures of various components of directed energy systems such as diodes 152 and amplifier 154, such systems can include components and features of the TMS disclosed herein. In FIG. 17, evaporator 52 is coupled to diodes 152 and amplifier 154, although it should be understood that embodiments with multiple evaporators could provide a separate evaporator to cool diodes 152 separately from amplifier 154. The other components of the TMS disclosed herein are not shown for clarity.

However, it should be understood that any of the features and components discussed above can optionally be included in directed energy systems. Diodes 152, due to their temperature-sensitive nature, effectively function as heat load 49*b* in system 150, while amplifier 154 may function as either a separate heat load 49*a* (separate evaporator 22) or as part of heat load 49*b*.

System 150 is one example of a directed energy system that can include various features and components of the TMS and methods described herein. However, it should be appreciated that the TMS and methods are general in nature, and is applied to cool a variety of different heat loads under a wide range of operating conditions.

Various combinations of the sensors can be used to measure thermodynamic properties of the TMS 10 that are used to adjust the control devices or pumps discussed above and which signals are processed by the controller 17. Connections (wired or wireless) are provided between each of the sensors and controller 17. In many embodiments, system includes only certain combinations of the sensors (e.g., one, two, three, or four of the sensors) to provide suitable control signals for the control devices.

Any two of the devices, as pressure sensors, upstream and downstream from a control device, can be configured to measure information about a pressure differential $p_r$-$p_e$ across the respective control device and to transmit electronic signals corresponding to the measured pressure from which a pressure difference information can be generated by the controller 17. Other sensors such as flow sensors and temperature sensors can be used as well. In certain embodiments, sensors can be replaced by a single pressure differential sensor, a first end of which is connected adjacent to an inlet and a second end of which is connected adjacent to an outlet of a device to which differential pressure is to be measured, such as the evaporator. The pressure differential sensor measures and transmits information about the refrigerant fluid pressure drop across the device, e.g., the evaporator 52.

Temperature sensors can be positioned adjacent to an inlet or an outlet of e.g., the evaporator 22 or between the inlet and the outlet. Such a temperature sensor measures temperature information for the refrigerant fluid within evaporator 22 (which represents the evaporating temperature) and transmits an electronic signal corresponding to the measured information. A temperature sensor can be attached to heat loads 49*a*, 49*b*, which measures temperature information for the load and transmits an electronic signal corresponding to the measured information. An optional temperature sensor can be adjacent to the outlet of evaporator 22 that measures and transmits information about the temperature of the refrigerant fluid as it emerges from evaporator 22.

In certain embodiments, the systems disclosed herein are configured to determine superheat information for the refrigerant fluid based on temperature and pressure information for the refrigerant fluid measured by any of the sensors disclosed herein. The superheat of the refrigerant vapor refers to the difference between the temperature of the refrigerant fluid vapor at a measurement point in the TMS 10 and the saturated vapor temperature of the refrigerant fluid defined by the refrigerant pressure at the measurement point in the TMS 10.

To determine the superheat associated with the refrigerant fluid, the system controller 17 (as described) receives information about the refrigerant fluid vapor pressure after emerging from a heat exchanger downstream from evaporator 22, and uses calibration information, a lookup table, a mathematical relationship, or other information to determine the saturated vapor temperature for the refrigerant fluid from the pressure information. The controller 17 also receives information about the actual temperature of the refrigerant fluid, and then calculates the superheat associated with the refrigerant fluid as the difference between the actual temperature of the refrigerant fluid and the saturated vapor temperature for the refrigerant fluid.

The foregoing temperature sensors can be implemented in a variety of ways in TMS 10. As one example, thermocouples and thermistors can function as temperature sensors in TMS 10. Examples of suitable commercially available temperature sensors for use in TMS 10 include, but are not limited to, the 88000 series thermocouple surface probes (available from OMEGA Engineering Inc., Norwalk, Conn.).

TMS 10 can include a vapor quality sensor that measures vapor quality of the refrigerant fluid emerging from evaporator 22. Typically, such a sensor is implemented as a capacitive sensor that measures a difference in capacitance between the liquid and vapor phases of the refrigerant fluid. The capacitance information can be used to directly determine the vapor quality of the refrigerant fluid (e.g., by system controller 17). Alternatively, sensor can determine the vapor quality directly based on the differential capacitance measurements and transmit an electronic signal that includes information about the refrigerant fluid vapor quality. Examples of commercially available vapor quality sensors that can be used in TMS 10 include, but are not limited to, HBX sensors (available from HB Products, Hasselager, Denmark).

It should generally understood that the systems disclosed herein can include a variety of combinations of the various sensors described above, and controller 17 can receive measurement information periodically or aperiodically from any of the various sensors. Moreover, it should be understood any of the sensors described can operate autonomously, measuring information and transmitting the information to controller 17 (or directly to the first and/or second control device) or, alternatively, any of the sensors described above can measure information when activated by controller 17 via a suitable control signal, and measure and transmit information to controller 17 in response to the activating control signal.

To adjust a control device on a particular value of a measured system parameter value, controller 17 compares the measured value to a set point value (or threshold value) for the system parameter. Certain set point values represent a maximum allowable value of a system parameter, and if the measured value is equal to the set point value (or differs from the set point value by 10% or less (e.g., 5% or less, 3% or less, 1% or less) of the set point value), controller 17 adjusts a respective control device to modify the operating state of the TMS 10. Certain set point values represent a minimum allowable value of a system parameter, and if the measured value is equal to the set point value (or differs from the set point value by 10% or less (e.g., 5% or less, 3% or less, 1% or less) of the set point value), controller 17 adjusts the respective control device to modify the operating state of the TMS 10, and increase the system parameter value. The controller 17 executes algorithms that use the measured sensor value(s) to provide signals that cause the various control devices to adjust refrigerant flow rates, etc.

Some set point values represent "target" values of system parameters. For such system parameters, if the measured parameter value differs from the set point value by 1% or more (e.g., 3% or more, 5% or more, 10% or more, 20% or more), controller 17 adjusts the respective control device to adjust the operating state of the system, so that the system parameter value more closely matches the set point value.

Optional pressure sensors are configured to measure information about the pressure differential $p_r$-$p_e$ across a control device and to transmit an electronic signal corresponding to the measured pressure difference information. Two sensors can effectively measure $p_r$, $p_e$. In certain embodiments two sensors can be replaced by a single pressure differential sensor. Where a pressure differential sensor is used, a first end of the sensor is connected upstream of a first control device and a second end of the sensor is connected downstream from first control device.

System also includes optional pressure sensors positioned at the inlet and outlet, respectively, of evaporator 22. A sensor measures and transmits information about the refrigerant fluid pressure upstream from evaporator 22, and a sensor measure and transmit information about the refrigerant fluid pressure downstream from evaporator 22. This information can be used (e.g., by a system controller) to calculate the refrigerant fluid pressure drop across evaporator 22. As above, in certain embodiments, sensors can be replaced by a single pressure differential sensor to measure and transmit the refrigerant fluid pressure drop across evaporator 22.

To measure the evaporating pressure ($p_e$) a sensor can be optionally positioned between the inlet and outlet of evaporator 22, i.e., internal to evaporator 22. In such a configuration, the sensor can provide a direct a direct measurement of the evaporating pressure.

To measure refrigerant fluid pressure at other locations within system, sensor can also optionally be positioned, for example, in-line along a conduit. Pressure sensors at each of these locations can be used to provide information about the refrigerant fluid pressure downstream from evaporator 22, or the pressure drop across evaporator 22.

It should be appreciated that, in the foregoing discussion, any one or various combinations of two sensors discussed in connection with system can correspond to the first measurement device connected to expansion valve 20, and any one or various combination of two sensors can correspond to the second measurement device. In general, as discussed previously, the first measurement device provides information corresponding to a first thermodynamic quantity to the first control device, and the second measurement device provides information corresponding to a second thermodynamic quantity to the second control device, where the first and second thermodynamic quantities are different, and therefore allow the first and second control device to independently control two different system properties (e.g., the vapor quality of the refrigerant fluid and the heat load temperature, respectively).

In some embodiments, one or more of the sensors shown in system are connected directly to expansion valve 20. The first and second control device can be configured to adaptively respond directly to the transmitted signals from the sensors, thereby providing for automatic adjustment of the system's operating parameters. In certain embodiments, the first and/or second control device can include processing hardware and/or software components that receive transmitted signals from the sensors, optionally perform computational operations, and activate elements of the first and/or second control device to adjust the control device in response to the sensor signals.

In addition, controller 17 is optionally connected to expansion valve 20. In embodiments where expansion valve 20 is implemented as a device controllable via an electrical control signal, controller 17 is configured to transmit suitable control signals to the first and/or second control device to adjust the configuration of these components. In particular, controller 17 is configured to adjust expansion valve 20 to control the vapor quality of the refrigerant fluid in the TMS 10.

During operation of the TMS 10, controller 17 typically receives measurement signals from one or more sensors. The measurements can be received periodically (e.g., at consistent, recurring intervals) or irregularly, depending upon the nature of the measurements and the manner in which the measurement information is used by controller 17. In some embodiments, certain measurements are performed by controller 17 after particular conditions—such as a measured parameter value exceeding or falling below an associated set point value—are reached.

For example, in some embodiments, expansion valve 20 is adjusted (e.g., automatically or by controller 17) based on a measurement of the evaporation pressure ($p_e$) of the refrigerant fluid and/or a measurement of the evaporation temperature of the refrigerant fluid. In certain embodiments, control device 20 is adjusted (e.g., automatically or by controller 17) based on a measurement of the temperature of thermal load 49*b*.

To adjust any of the control devices 18, 20, 50, 54, 64, and 47, the compressor 24, and/or the pumps 40 and 80, etc., based on a particular value of a measured system parameter value, controller 17 compares the measured value to a set point value (or threshold value) for the system parameter. Certain set point values represent a maximum allowable value of a system parameter, and if the measured value is equal to the set point value (or differs from the set point value by 10% or less (e.g., 5% or less, 3% or less, 1% or less) of the set point value), controller 17 adjusts control device 20 to adjust the operating state of the system, and reduce the system parameter value.

Certain set point values represent a minimum allowable value of a system parameter, and if the measured value is equal to the set point value (or differs from the set point value by 10% or less (e.g., 5% or less, 3% or less, 1% or less) of the set point value), controller 17 adjusts expansion valve 20, etc. to adjust the operating state of the system, and increase the system parameter value.

Some set point values represent "target" values of system parameters. For such system parameters, if the measured parameter value differs from the set point value by 1% or more (e.g., 3% or more, 5% or more, 10% or more, 20% or more), controller 17 adjusts expansion valve 20, etc. to adjust the operating state of the system, so that the system parameter value more closely matches the set point value.

Measured parameter values are assessed in relative terms based on set point values (i.e., as a percentage of set point values). Alternatively, in some embodiments, measured parameter values can be accessed in absolute terms. For example, if a measured system parameter value differs from a set point value by more than a certain amount (e.g., by 1 degree C. or more, 2 degrees C. or more, 3 degrees C. or more, 4 degrees C. or more, 5 degrees C. or more), then controller 17 adjusts expansion valve 20, etc. to adjust the operating state of the system, so that the measured system parameter value more closely matches the set point value.

In the foregoing examples, measured parameter values are assessed in relative terms based on set point values (i.e., as a percentage of set point values). Alternatively, in some embodiments, measured parameter values can be in absolute terms. For example, if a measured system parameter value differs from a set point value by more than a certain amount (e.g., by 1 degree C. or more, 2 degrees C. or more, 3 degrees C. or more, 4 degrees C. or more, 5 degrees C. or more), then controller 17 adjusts expansion valve 20, etc. to adjust the operating state of the system, so that the measured system parameter value more closely matches the set point value.

VIII. Hardware and Software Implementations

Figure 18:
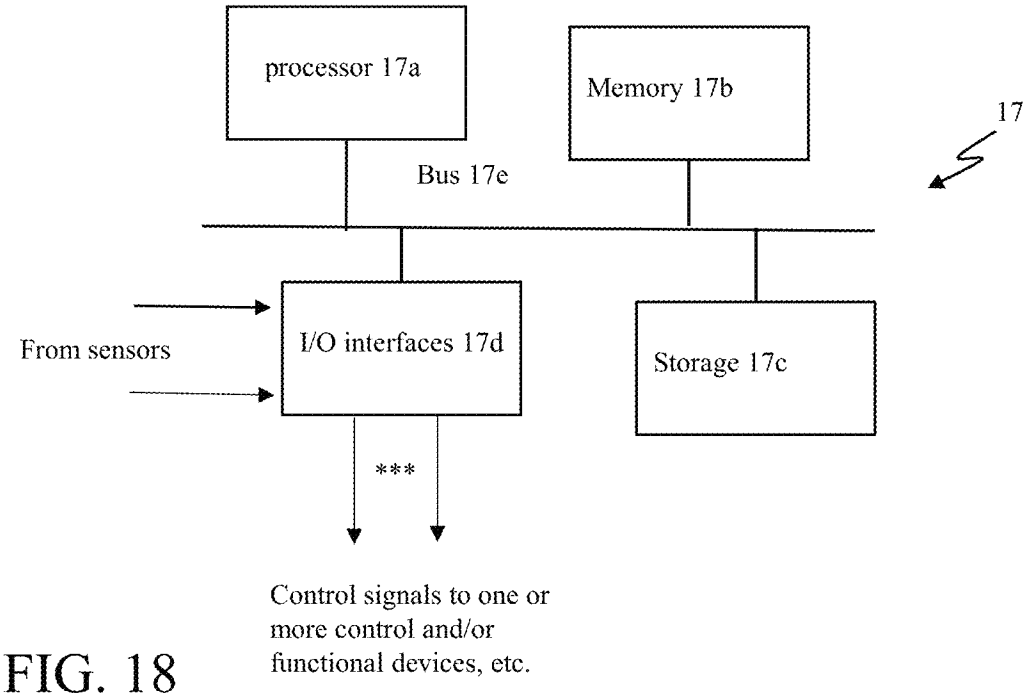
FIG. 18 is a block diagram of a controller.

Referring now to FIG. 18, a controller 17 can generally be implemented as any one of a variety of different electrical or electronic computing or processing devices, and can perform any combination of the various steps discussed above to control various components of the disclosed TMS.

Controller 17 can generally, and optionally, include any one or more of a processor 17*a* (or multiple processors), a memory 17*b*, a storage device 17*c*, and input/output devices or interfaces 17*d*. Some or all of these components are interconnected using a system bus 17*e*. The processor 17*a* is capable of processing instructions for execution. In some embodiments, the processor 17*a* is a single-threaded processor. In certain embodiments, the processor 17*a* is a multi-threaded processor. Typically, the processor 17*a* is capable of processing instructions stored in the memory 17*b* or on the storage device 17*c* to display graphical information for a user interface on an input/output device 17*d*, and to execute the various monitoring and control functions discussed above. Suitable processors for the systems disclosed herein include both general and special purpose microprocessors, and the sole processor or one of multiple processors of any kind of computer or computing device.

The memory 17*b* stores information within the system, and is a computer-readable medium, such as a volatile or non-volatile memory. The storage device 17*c* is capable of providing mass storage for the controller 17. In general, the storage device 17*c* can include any non-transitory tangible media configured to store computer readable instructions. For example, the storage device 17*c* can include a computer-readable medium and associated components, including: magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. Processors and memory units of the systems disclosed herein is supplemented by, or incorporated in, ASICs (application-specific integrated circuits).

The input/output devices 17*d* provide input/output operations for controller 17, and can include a keyboard and/or pointing device. In some embodiments, the input/output devices 17*d* include a display unit for displaying graphical user interfaces and system related information.

The features described herein, including components for performing various measurement, monitoring, control, and communication functions, is implemented in digital electronic circuitry, or in computer hardware, firmware, or in combinations of them. Methods steps is implemented in a computer program product tangibly embodied in an information carrier, e.g., in a machine-readable storage device, for execution by a programmable processor (e.g., of controller 17), and features are performed by a programmable processor executing such a program of instructions to perform any of the steps and functions described above. Computer programs suitable for execution by one or more system processors include a set of instructions that are used, directly or indirectly, to cause a processor or other computing device executing the instructions to perform certain activities, including the various steps discussed above.

Computer programs suitable for use with the systems and methods disclosed herein is written in any form of programming language, including compiled or interpreted languages, and is deployed in any form, including as standalone programs or as modules, components, subroutines, or other units suitable for use in a computing environment.

In addition to one or more processors and/or computing components implemented as part of controller 17, the systems disclosed herein can include additional processors and/or computing components within any of the control device (e.g., expansion device 18 and/or 52 and/or back-pressure regulator 24) and any of the sensors discussed above. Processors and/or computing components of the control device and sensors, and software programs and instructions that are executed by such processors and/or computing components, can generally have any of the features discussed above in connection with controller 17.

OTHER EMBODIMENTS

A number of embodiments have been described. Nevertheless, it will be understood that various modifications may be made without departing from the spirit and scope of the disclosure. Accordingly, other embodiments are within the scope of the following claims.

What is claimed is:

1. A thermal management system, comprising:

a receiver configured to store a refrigerant fluid, the receiver comprising a receiver inlet and a receiver outlet;

a closed-circuit refrigeration system, comprising:

a vapor compression closed-circuit system that includes the receiver and further comprises:

a first evaporator and a second evaporator, each of the first and second evaporator comprising an inlet and an outlet;

a liquid comprising an inlet, a liquid-side outlet, and a vapor-side outlet; and an ejector comprising a primary inlet configured to receive the refrigerant fluid from the receiver and an outlet configured to deliver the refrigerant fluid to the liquid separator from the outlet of the first evaporator;

a closed-circuit system that includes the receiver and further comprises:

a third evaporator comprising an inlet and an outlet;

wherein the closed-circuit refrigeration system is configured to receive the refrigerant fluid from the receiver through at least one of the vapor compression closed-circuit system or the closed-circuit system; and an open-circuit refrigeration system comprising an open-circuit fluid path that extends from the receiver outlet to an exhaust line.

2. The system of claim 1, wherein the ejector further comprises a secondary inlet configured to receive the refrigerant fluid from the outlet of the second evaporator.

3. The system of claim 2, wherein the refrigerant fluid received at the secondary inlet is entrained by a flow of the refrigerant fluid received at the primary inlet.

4. The system of claim 1, wherein each of the first and second evaporators of the vapor compression closed-circuit system is configured to receive the refrigerant fluid from the receiver and to extract heat from at least one heat load.

5. The system of claim 1, wherein the third evaporator is configured to receive the refrigerant fluid from the receiver and to extract heat from at least one heat load.

6. The system of claim 1, wherein the closed-circuit refrigeration system further comprises:

a compressor comprising a compressor inlet coupled to an outlet of the first evaporator and a compressor outlet, the compressor configured to receive a superheated refrigerant vapor at the compressor inlet and deliver a compressed refrigerant vapor at the compressor outlet; and a condenser comprising a condenser inlet coupled to the compressor outlet and a condenser outlet coupled to the receiver inlet, the condenser configured to condense the compressed refrigerant vapor received from the compressor.

7. The system of claim 6, further comprising:

an expansion valve that is disposed at the inlet of the first evaporator and is configured to cause an adiabatic flash evaporation of a part of the refrigerant fluid received from the receiver.

8. The system of claim 7, wherein the expansion valve is configured to control a vapor quality of the refrigerant fluid at the outlet of the first evaporator.

9. The system of claim 6, wherein the closed-circuit system further comprises:

a pump configured to receive the refrigerant fluid from the receiver and pump the received refrigerant fluid to the inlet of the third evaporator.

10. The system of claim 9, wherein the closed-circuit system comprises the condenser, but excludes the compressor.

11. The system of claim 9, wherein the closed-circuit system further comprises:

a junction device comprising a first outlet that is coupled to the condenser inlet; and a check valve coupled between the outlet of the third evaporator and an inlet of the junction device.

12. The system of claim 1, wherein the open-circuit refrigeration system comprises:

a junction device comprising an inlet and first and second outlets, with the first outlet coupled to the compressor inlet, and with the open-circuit refrigeration system including the receiver outlet, the first and second evaporators, the liquid separator, and the exhaust line, and with the open-circuit refrigeration system configured to receive the refrigerant fluid from the receiver and controllably discharge the refrigerant fluid without the discharged refrigerant being returned to the receiver.

13. The system of claim 12, wherein the open-circuit refrigeration system further comprises:

a back-pressure regulator comprising an inlet coupled to the second outlet of the junction device.

14. The system of claim 12, wherein the open-circuit refrigeration system is configured to discharge the refrigerant fluid from the exhaust line as a refrigerant vapor.

15. The system of claim 9, wherein the closed-circuit system further comprises:

a fourth evaporator comprising an inlet configured to receive the refrigerant fluid and an outlet configured to send the refrigerant fluid towards the condenser.

16. The system of claim 15, wherein the closed-circuit system further comprises:

a junction device comprising first and second inlets and an outlet, with the outlet coupled to the condenser inlet; and a check valve comprising an inlet and an outlet, with the outlet of the check valve coupled to the second inlet of the junction device, and with the first inlet coupled to the outlets of the third and fourth evaporators.

17. The system of claim 15, wherein the closed-circuit system further comprises:

a control valve comprising an inlet coupled to the outlet of the third evaporator, and having an outlet coupled to the inlet of the check valve.

18. The system of claim 9, wherein the system further comprises:

a three-way junction device comprising an inlet and first and second outlets, with the inlet coupled to the outlet of the receiver, the first outlet coupled to an inlet of the pump and the second outlet coupled to the primary inlet of the ejector.

19. The system of claim 18, wherein the vapor compression closed-circuit system further comprises:

a first expansion valve comprising an inlet configured to receive the refrigerant fluid from the receiver and an outlet coupled to the inlet of the first evaporator.

20. The system of claim 1, wherein the refrigerant comprises ammonia.

21. A thermal management method, comprising:

transporting a refrigerant fluid from a receiver that stores the refrigerant fluid through a closed-circuit refrigeration system, with the closed-circuit refrigeration system comprising a vapor compression closed-circuit system that includes first and second evaporators, an ejector, a liquid separator, and the receiver;

transporting the refrigerant fluid from the receiver through a closed-circuit system of the closed-circuit refrigeration system, the closed-circuit system including the receiver and a third evaporator;

receiving the refrigerant fluid at the receiver through at least one of the vapor compression closed-circuit refrigeration system or the closed-circuit system;

transporting the refrigerant fluid through the closed-circuit system to the third evaporator; and extracting heat from at least one heat load thermally coupled to the third evaporator.

22. The method of claim 21, further comprising:

transporting the refrigerant fluid through the vapor compression closed-circuit system to the first and second evaporators; and extracting heat from at least one heat load in proximity to each of the first and second evaporators.

23. The method of claim 21, further comprising:

compressing a refrigerant vapor received by a compressor from a vapor side outlet of the liquid separator, with the compressor providing compressed superheated refrigerant vapor at a compressor outlet;

removing heat from the compressed superheated refrigerant vapor received by a condenser coupled to the compressor outlet, with the condenser providing the refrigerant fluid at a condenser outlet; and transporting the refrigerant fluid to an inlet of the receiver.

24. The method of claim 23, further comprising:

transporting the refrigerant fluid through an expansion device that is disposed at the first evaporator inlet; and causing an adiabatic flash evaporation of a part of a liquid refrigerant in the refrigerant fluid received from the receiver.

25. The method of claim 24, further comprising:

controlling a vapor quality of the refrigerant fluid at the outlet of the first evaporator by operation of the expansion device.

26. The method of claim 21, further comprising:

pumping, with at least one pump of the closed-circuit system, the refrigerant fluid from the receiver into the third evaporator.

27. The method of claim 26, wherein the closed-circuit system further comprises the condenser.

28. The method of claim 26, wherein the closed-circuit system excludes the compressor.

29. The method of claim 26, further comprising:

receiving the refrigerant fluid from the third evaporator by a junction device that has a first port coupled to the condenser inlet and a second port coupled to a check valve that is coupled to the outlet of the third evaporator.

30. The method of claim 21, wherein the refrigerant comprises ammonia.

31. The method of claim 21, further comprising:

transporting a portion of a refrigerant vapor from the first and second evaporators into an inlet of the liquid separator that has a vapor-side outlet coupled to an inlet of a junction device; and transporting the portion of the refrigerant vapor from the liquid separator to a back-pressure regulator that comprises an inlet coupled to the vapor-side outlet of the liquid separator.

32. The method of claim 26, further comprising:

exhausting a portion of the refrigerant vapor received from a vapor-side outlet of the liquid separator through a back-pressure regulator that comprises an inlet coupled to the vapor-side outlet of the liquid separator and an outlet coupled to an exhaust line without returning the portion of the refrigerant vapor to the receiver.

33. The method of claim 32, wherein the refrigerant fluid comprises ammonia and, during operation of the open-circuit refrigeration system, ammonia is discharged from the exhaust line as a vapor.

34. A thermal management method, comprising:

transporting a refrigerant fluid from a receiver that stores the refrigerant fluid through a closed-circuit refrigeration system, with the closed-circuit refrigeration system comprising a vapor compression closed-circuit system that includes first and second evaporators, an ejector, a liquid separator, and the receiver;

transporting the refrigerant fluid from the receiver through a closed-circuit system of the closed-circuit refrigeration system, the closed-circuit system including the receiver and a third evaporator;

receiving the refrigerant fluid at the receiver through at least one of the vapor compression closed-circuit refrigeration system or the closed-circuit system;

transporting a portion of a refrigerant vapor from the first and second evaporators into an inlet of the liquid separator that has a vapor-side outlet coupled to an inlet of a junction device;

transporting the portion of the refrigerant vapor from the liquid separator to a back-pressure regulator having an inlet coupled to the vapor-side outlet of the liquid separator; and pumping, with at least one pump of the closed-circuit system, the refrigerant fluid from the receiver into the third evaporator.

35. The method of claim 34, further comprising:

compressing a refrigerant vapor received by a compressor from a vapor side outlet of the liquid separator, with the compressor providing compressed superheated refrigerant vapor at a compressor outlet;

removing heat from the compressed superheated refrigerant vapor received by a condenser coupled to the compressor outlet, with the condenser providing the refrigerant fluid at a condenser outlet; and transporting the refrigerant fluid to an inlet of the receiver.

36. The method of claim 35, further comprising:

transporting the refrigerant fluid through an expansion device that is disposed at the first evaporator inlet; and causing an adiabatic flash evaporation of a part of a liquid refrigerant in the refrigerant fluid received from the receiver.

37. The method of claim 36, further comprising:

controlling a vapor quality of the refrigerant fluid at the outlet of the first evaporator by operation of the expansion device.

38. The method of claim 35, wherein the closed-circuit system further comprises the condenser.

39. The method of claim 35, wherein the closed-circuit system excludes the compressor.

40. The method of claim 39, wherein the junction device is a first junction device, the method further comprising:

receiving the refrigerant fluid from the third evaporator by a second junction device that has a first port coupled to the condenser inlet and a second port coupled to a check valve that is coupled to the outlet of the third evaporator.

41. The method of claim 34, wherein the refrigerant comprises ammonia.

42. The method of claim 34, further comprising:

exhausting a portion of the refrigerant vapor received from a vapor-side outlet of the liquid separator through the back-pressure regulator that comprises an inlet coupled to the vapor-side outlet of the liquid separator and an outlet coupled to an exhaust line without returning the portion of the refrigerant vapor to the receiver.

43. The method of claim 42, wherein the refrigerant fluid comprises ammonia.

44. A thermal management method, comprising:

transporting a refrigerant fluid from a receiver that stores the refrigerant fluid through a closed-circuit refrigeration system, with the closed-circuit refrigeration system comprising a vapor compression closed-circuit system that includes first and second evaporators, an ejector, a liquid separator, and the receiver;

transporting the refrigerant fluid from the receiver through a closed-circuit system of the closed-circuit refrigeration system, the closed-circuit system including the receiver and a third evaporator;

receiving the refrigerant fluid at the receiver through at least one of the vapor compression closed-circuit refrigeration system or the closed-circuit system;

transporting a portion of a refrigerant vapor from the first and second evaporators into an inlet of the liquid separator that has a vapor-side outlet coupled to an inlet of a junction device;

transporting the portion of the refrigerant vapor from the liquid separator to a back-pressure regulator having an inlet coupled to the vapor-side outlet of the liquid separator; and exhausting a portion of the refrigerant vapor received from a vapor-side outlet of the liquid separator through the back-pressure regulator that comprises an inlet coupled to the vapor-side outlet of the liquid separator and an outlet coupled to an exhaust line without returning the portion of the refrigerant vapor to the receiver.

45. The method of claim 44, further comprising:

compressing a refrigerant vapor received by a compressor from a vapor side outlet of the liquid separator, with the compressor providing compressed superheated refrigerant vapor at a compressor outlet;

removing heat from the compressed superheated refrigerant vapor received by a condenser coupled to the compressor outlet, with the condenser providing the refrigerant fluid at a condenser outlet; and transporting the refrigerant fluid to an inlet of the receiver.

46. The method of claim 45, further comprising:

transporting the refrigerant fluid through an expansion device that is disposed at the first evaporator inlet; and causing an adiabatic flash evaporation of a part of a liquid refrigerant in the refrigerant fluid received from the receiver.

47. The method of claim 46, further comprising:

controlling a vapor quality of the refrigerant fluid at the outlet of the first evaporator by operation of the expansion device.

48. The method of claim 45, wherein the closed-circuit system further comprises the condenser.

49. The method of claim 45, wherein the closed-circuit system excludes the compressor.

50. The method of claim 49, wherein the junction device is a first junction device, the method further comprising:

receiving the refrigerant fluid from the third evaporator by a second junction device that has a first port coupled to the condenser inlet and a second port coupled to a check valve that is coupled to the outlet of the third evaporator.

51. The method of claim 44, wherein the refrigerant fluid comprises ammonia.

* * * * *